US010791903B2

(12) United States Patent
Krebs et al.

(10) Patent No.: US 10,791,903 B2
(45) Date of Patent: Oct. 6, 2020

(54) STEAM CLEANING APPARATUS

(71) Applicant: BISSELL Homecare, Inc., Grand Rapids, MI (US)

(72) Inventors: Alan J. Krebs, Pierson, MI (US); Chi Keung Li, Sai Ying Pun (HK); Jing Yang, Zhongshan (CN); Ming Luo, Shenzhen (CN)

(73) Assignee: BISSELL Inc., Grand Rapids, MI (US)

( * ) Notice: Subject to any disclaimer, the term of this patent is extended or adjusted under 35 U.S.C. 154(b) by 347 days.

(21) Appl. No.: 15/885,135

(22) Filed: Jan. 31, 2018

(65) Prior Publication Data

US 2018/0213995 A1 Aug. 2, 2018

Related U.S. Application Data

(60) Provisional application No. 62/452,699, filed on Jan. 31, 2017.

(51) Int. Cl.

| | |
|---|---|
| ***A47L 11/40*** | (2006.01) |
| ***A47L 13/22*** | (2006.01) |
| ***A47L 11/34*** | (2006.01) |

(52) U.S. Cl.

CPC ..... *A47L 11/4086* (2013.01); *A47L 11/34* (2013.01); *A47L 11/4075* (2013.01); *A47L 11/4083* (2013.01); *A47L 13/225* (2013.01); *B08B 2230/01* (2013.01)

(58) Field of Classification Search

CPC ..... A47L 11/4086; A47L 11/34

See application file for complete search history.

(56) References Cited

U.S. PATENT DOCUMENTS

| | | | |
|---|---|---|---|
| 6,031,969 | A | 2/2000 | Burr |
| 8,926,208 | B2 | 1/2015 | Braun |
| 9,320,405 | B2 | 4/2016 | Perry |
| 2004/0146332 | A1 | 7/2004 | Fu |
| 2007/0169304 | A1 | 7/2007 | Tsai |
| 2016/0345795 | A1 | 12/2016 | Manning |
| 2017/0127901 | A1 | 5/2017 | Pi |
| 2017/0231455 | A1 | 8/2017 | Yang |

FOREIGN PATENT DOCUMENTS

| | | | |
|---|---|---|---|
| CA | 2843333 | AA | 9/2014 |
| CN | 103654634 | A | 3/2014 |
| EP | 0253910 | A1 | 1/1988 |
| EP | 0616790 | A2 | 9/1994 |
| EP | 1690488 | A1 | 8/2006 |
| GB | 2276811 | A1 | 10/1994 |
| GB | 2522668 | A1 | 8/2015 |
| WO | 199812285 | A1 | 6/1998 |
| WO | 2009137792 | A2 | 11/2009 |

OTHER PUBLICATIONS

Klaus Hubrich, European Search Report, dated May 24, 2018, 7 pages, Munich.

*Primary Examiner* — Andrew A Horton

(74) *Attorney, Agent, or Firm* — McGarry Bair PC

(57) ABSTRACT

A steam cleaning apparatus for delivering steam of a surface to be cleaned is provided with a steam unit, a handle tube and an indexable base. The base can be indexed between a wide orientation where a long edge of the base is orthogonal to the direction of travel and a narrow orientation where a short edge of the base is orthogonal to the direction of travel.

20 Claims, 20 Drawing Sheets

STEAM CLEANING APPARATUS

CROSS-REFERENCE TO RELATED APPLICATION(S)

This application claims the benefit of U.S. Provisional Patent Application No. 62/452,699, filed Jan. 31, 2017, which is incorporated herein by reference in its entirety.

BACKGROUND

Surface cleaning apparatus with steam delivery, such as steam mops, are well-known devices for cleaning floor surfaces, such as tile, linoleum, vinyl, laminate, and hardwood floors. Typical steam mops have a reservoir for storing water that is fluidly connected to a selectively engageable pump or valve. The pump or valve outlet is fluidly connected to a steam boiler with a heating element to heat the water. The steam boiler generates steam, which is directed towards the surface to be cleaned through a nozzle or manifold mounted in a foot assembly that engages the floor surface. Steam is typically applied to the backside of a cleaning pad attached to the foot assembly. Steam vapor eventually saturates the entire cleaning pad as the moisture wicks outwardly from the point of steam application. The damp pad is wiped across the floor surface to remove dirt, dust, and debris present on the floor surface.

BRIEF SUMMARY

According to one aspect of the invention, a steam cleaning apparatus includes a steam unit, an elongated handle tube coupled with an outlet of the steam unit, a base coupled with the handle tube and adapted to move over a surface to be cleaned in a direction of travel, the base having a base housing with a long edge and a short edge that is shorter than the long edge, and an indexing mechanism configured to move at least the base housing between a wide orientation where the long edge of the base housing is orthogonal to the direction of travel and a narrow orientation where the short edge of the base housing is orthogonal to the direction of travel.

BRIEF DESCRIPTION OF THE DRAWINGS

The invention will now be described with respect to the drawings in which.

DESCRIPTION OF EMBODIMENTS OF THE INVENTION

The invention relates to a surface cleaning apparatus such as a steam cleaning apparatus or steam mop, for steam cleaning surfaces. More specifically, the invention relates to a steam mop that can be converted into different use configurations, including hand-held use.

Figure 1:
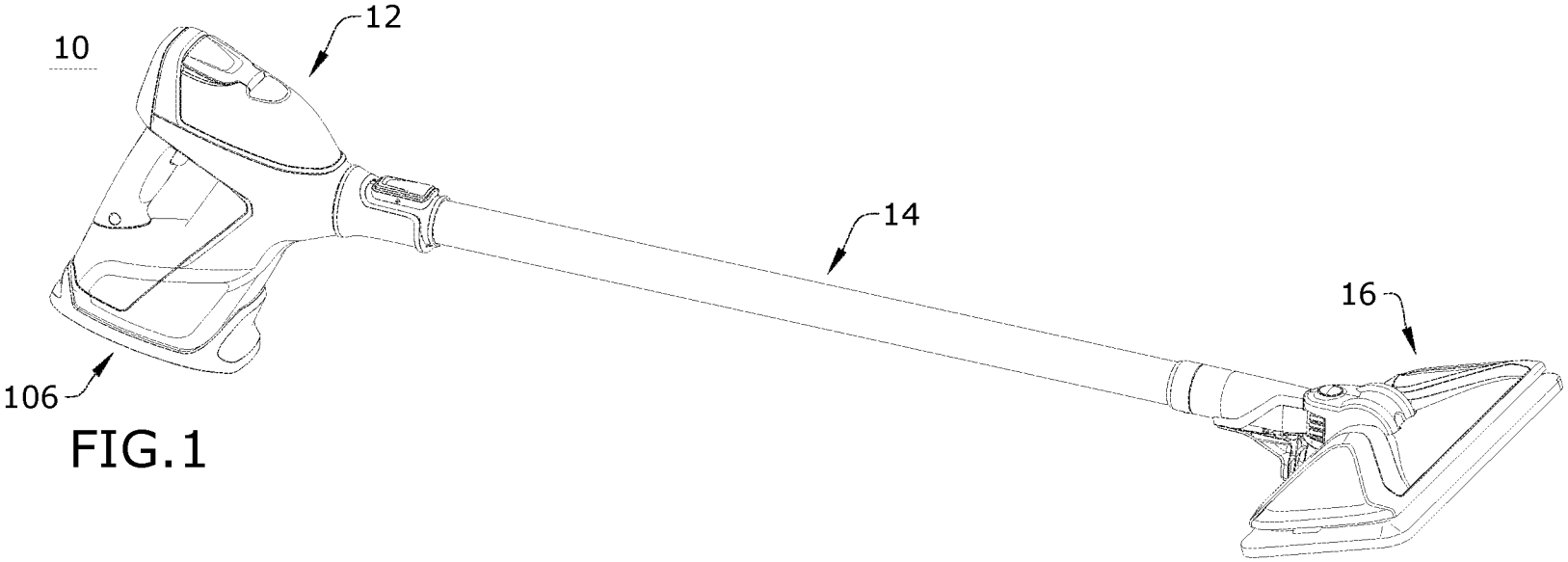
FIG. 1 is a perspective view of a steam cleaning apparatus in the form of a convertible steam mop according to one embodiment of the invention, with the steam mop in an upright or mopping mode of operation.

FIG. 1 is a perspective view of a steam cleaning apparatus 10 according to one embodiment of the invention. The steam cleaning apparatus 10 of the illustrated embodiment may alternatively be referred to herein as a steam mop, and includes a steam unit 12, a detachable handle tube 14 and a base 16 adapted to move over a surface to be cleaned. The steam mop 10 can generate and deliver steam to a surface to be cleaned, including floor surfaces, such as tile, linoleum, vinyl, laminate, and hardwood floors, and other hard surfaces such as tiles and countertops. The steam mop 10 is convertible between different modes of operation to efficiently clean different surface types and hard-to-reach areas.

For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the steam unit 12 and holding the steam unit 12 by its grip, which defines a rear of the steam unit 12 or steam cleaning apparatus. However, it is to be understood that the invention may assume various alternative orientations, except where expressly specified to the contrary.

Figure 2:
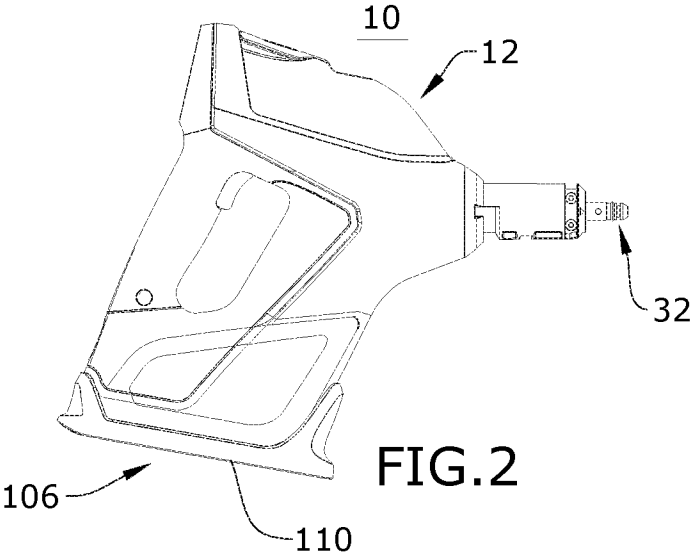
FIG. 2 is a perspective view of the steam cleaning apparatus of FIG. 1 in a handheld mode of operation.

The steam unit 12 can comprise a modular, handheld steam unit 12 that can be used independently of the handle tube 14 and base 16 to clean a surface. Thus, the handle tube 14 and base 16 are removable or detachable from the steam unit 12. The steam mop 10 is convertible between at least two different modes of operation, including an upright or mopping mode of operation shown in FIG. 1, in which the handle tube 14 and base 16 are attached to the steam unit 12, and a handheld mode of operation shown in FIG. 2, in which the handle tube 14 and base 16 are detached from the steam unit 12. The upright or mopping mode may be useful for cleaning floor surfaces, such as tile, linoleum, vinyl, laminate, and hardwood floors, while the handheld mode may be useful for cleaning other hard surfaces such as tiles and countertops.

Figure 3:
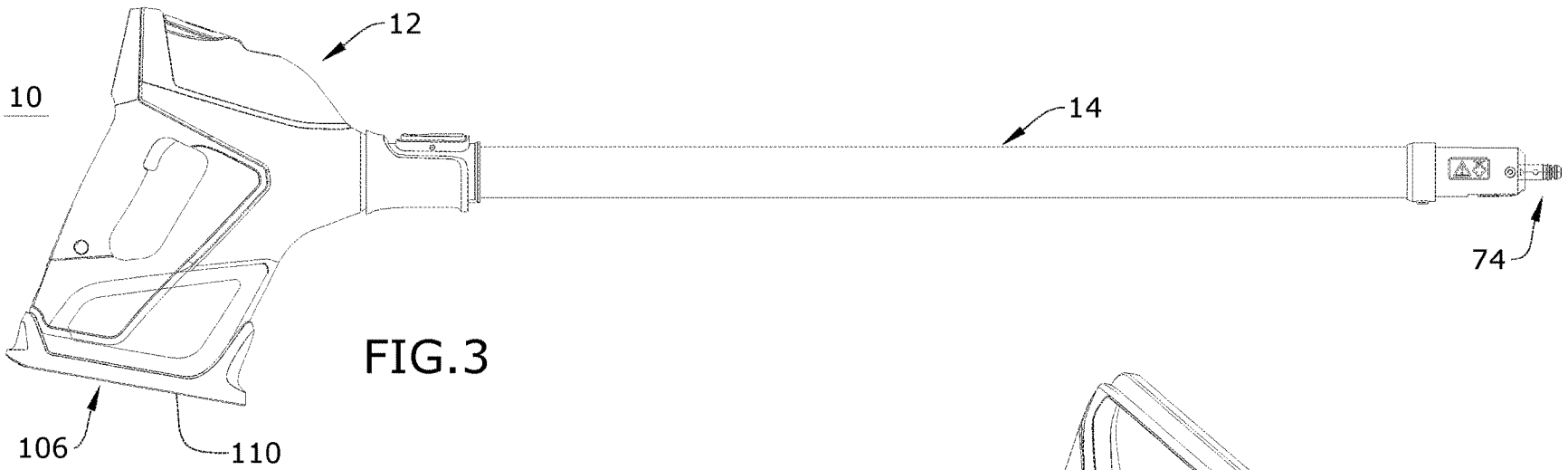
FIG. 3 is a perspective view of the steam cleaning apparatus of FIG. 1 in a remote cleaning mode of operation.
Figure 4:
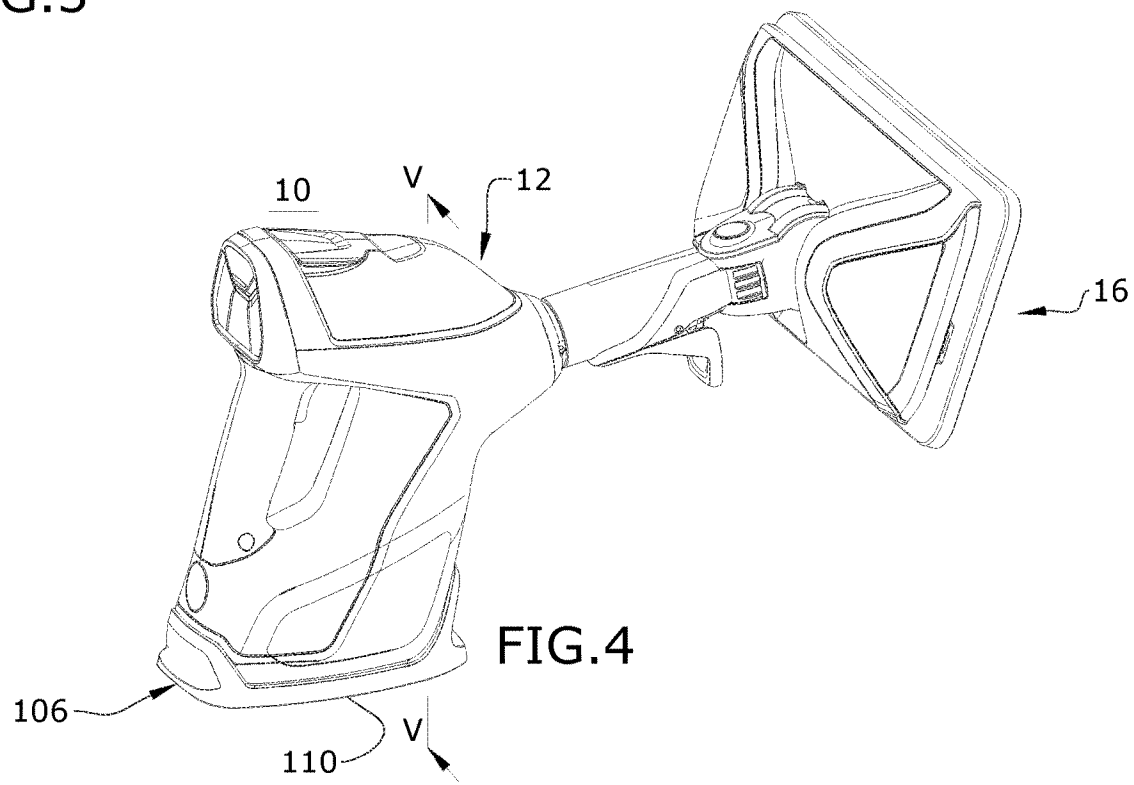
FIG. 4 is a perspective view of the steam cleaning apparatus of FIG. 1 in a handheld accessory mode of operation.
Figure 12:
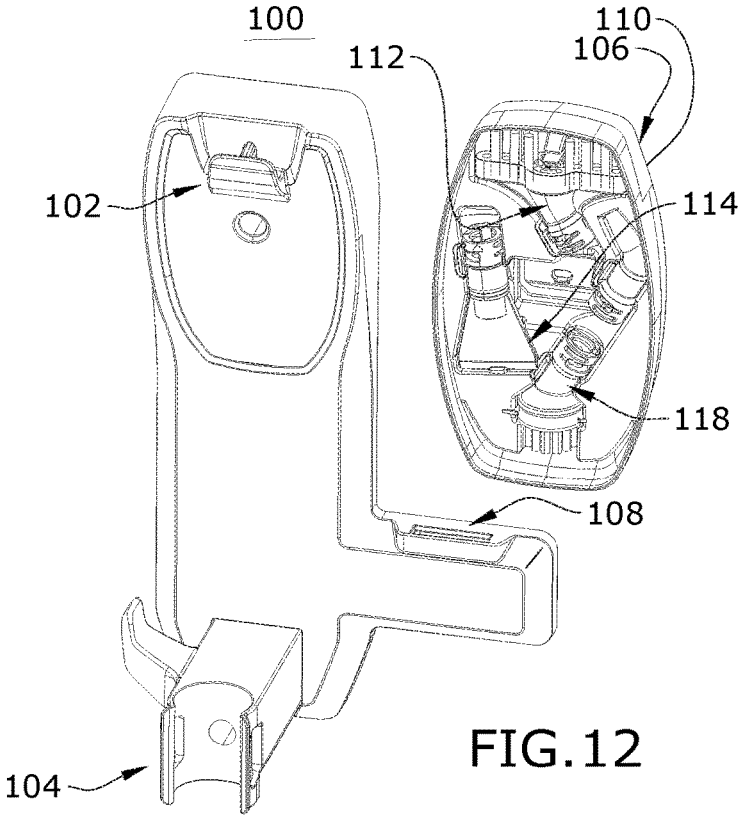
FIG. 12 is a perspective view of the wall hanger unit of FIG. 11, with a tool caddy exploded from the wall hanger unit.

The steam mop 10 can further be provided with other modes of operation, such as a remote cleaning mode of operation, shown in FIG. 3, in which the handle tube 14 is attached to the steam unit 12 and the base 16 is removed, which allows the steam mop 10 to clean remote or hard to reach areas. Another mode of operation is a handheld accessory mode of operation, one example of which is shown in FIG. 4, in which the handle tube 14 is detached from the steam unit 12, and a cleaning accessory tool is attached in its place. For example, the base 16 itself can be directly attached to the steam unit 12. Other examples of accessory tools that can be used in the handheld accessory mode are shown in FIG. 12.

Figure 5:
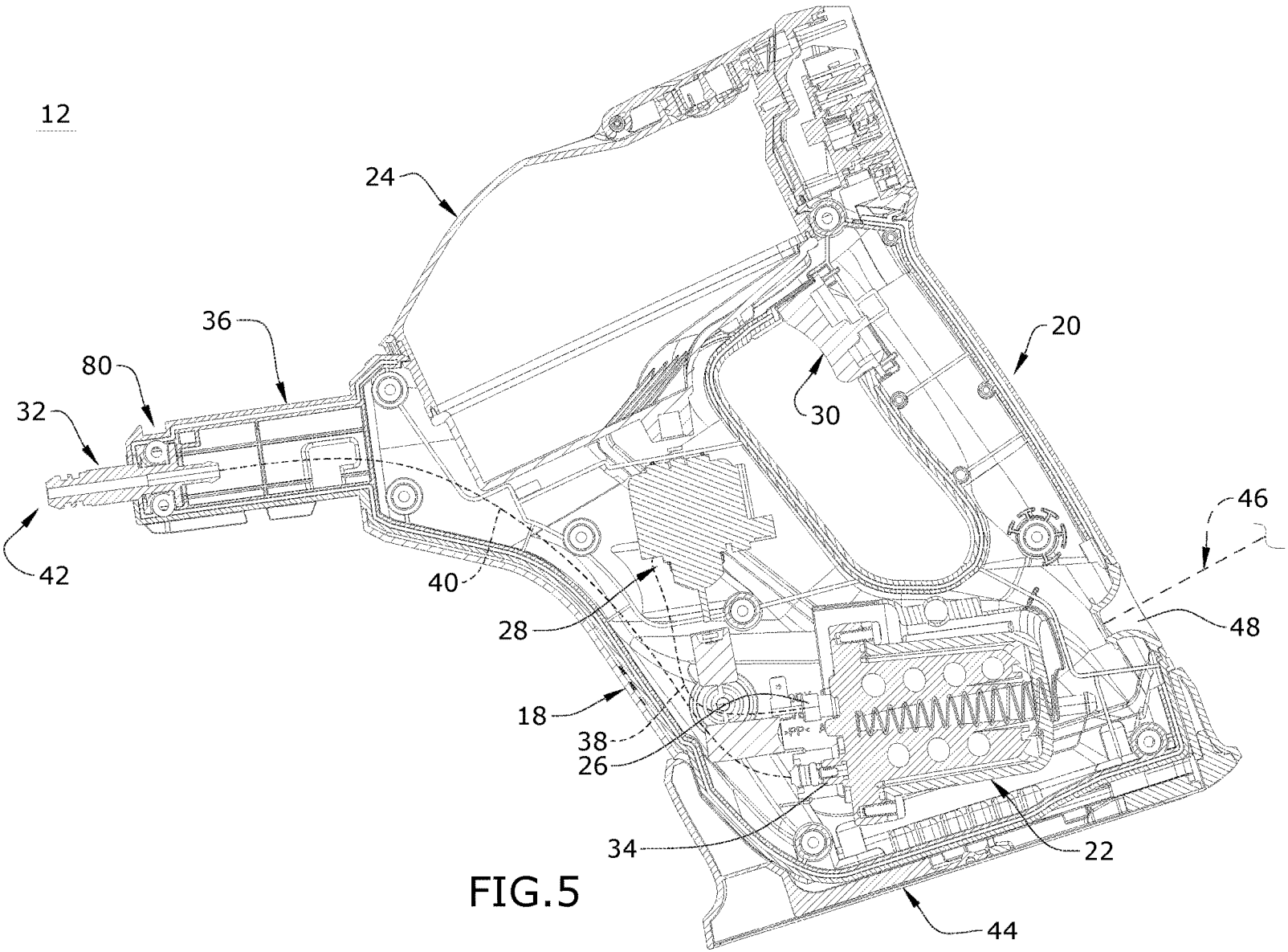
FIG. 5 is a cross-sectional view through line V-V of FIG. 4, showing a steam unit of the steam cleaning apparatus of FIG. 1.

FIG. 5 is a cross-sectional view through the steam unit 12 of the steam cleaning apparatus 10 of FIG. 1. The steam unit 12 can comprise a housing 18 with a pistol-style grip 20 and which carries a steam delivery system for generating steam and delivering the steam to a surface to be cleaned. The steam delivery system can include a steam generator 22 in the form of a heater for heating liquid to at least 100° C. to generate steam, a supply tank 24 in fluid communication with an inlet 26 of the steam generator 22, a pump 28 which pressurizes the delivery system to supply liquid from the tank 24 to the steam generator 22, an actuator 30 for the pump 28 to deliver liquid on demand to the steam generator 22, and a steam distribution nozzle 32 in fluid communication with an outlet 34 of the steam generator 22 for delivering steam to a surface to be cleaned directly, or indirectly via the handle tube 14, base 16, or another cleaning tool as described in further detail below. The steam distribution nozzle 32 can be provided on a steam outlet conduit 36 protruding from the steam unit housing 18. The steam outlet conduit 36 can further mount various attachments, including the handle tube 14 and/or one or more cleaning tools described herein. Flexible tubing or other suitable fluid conduits 38, 40 can connect pump 28 with the steam generator inlet 26 and the steam generator outlet 34 with the steam distribution nozzle 32, respectively.

The liquid in the supply tank 24 can comprise one or more of any suitable cleaning liquids, including, but not limited to, water or mixtures containing water. The supply tank 24 can be removable from the housing 18 for refilling the tank 24 with liquid, or can be refilled when on the housing 18.

The steam distribution nozzle 32 can include at least one nozzle outlet 42 on the unit housing 18 for delivering steam to a surface to be cleaned. The steam distribution nozzle 32 can be in an opposing relationship to the pistol grip 20, with the steam distribution nozzle 32 on a forward end of the unit housing 18 and the pistol grip 20 a rearward end of the unit housing 18. A bottom 44 of the unit housing 18 can define a substantially flat surface on which the unit 12 can rest in an upright position.

A power cord 46, which emerges from the interior of the housing 18 through a cord aperture 48, can be used to provide power to electrical components of the steam mop 10 from a source of power, such as a home power supply, upon actuation of the actuator 30. Alternatively, the steam mop 10 can be powered by a portable power supply, such as a battery.

Figure 6:
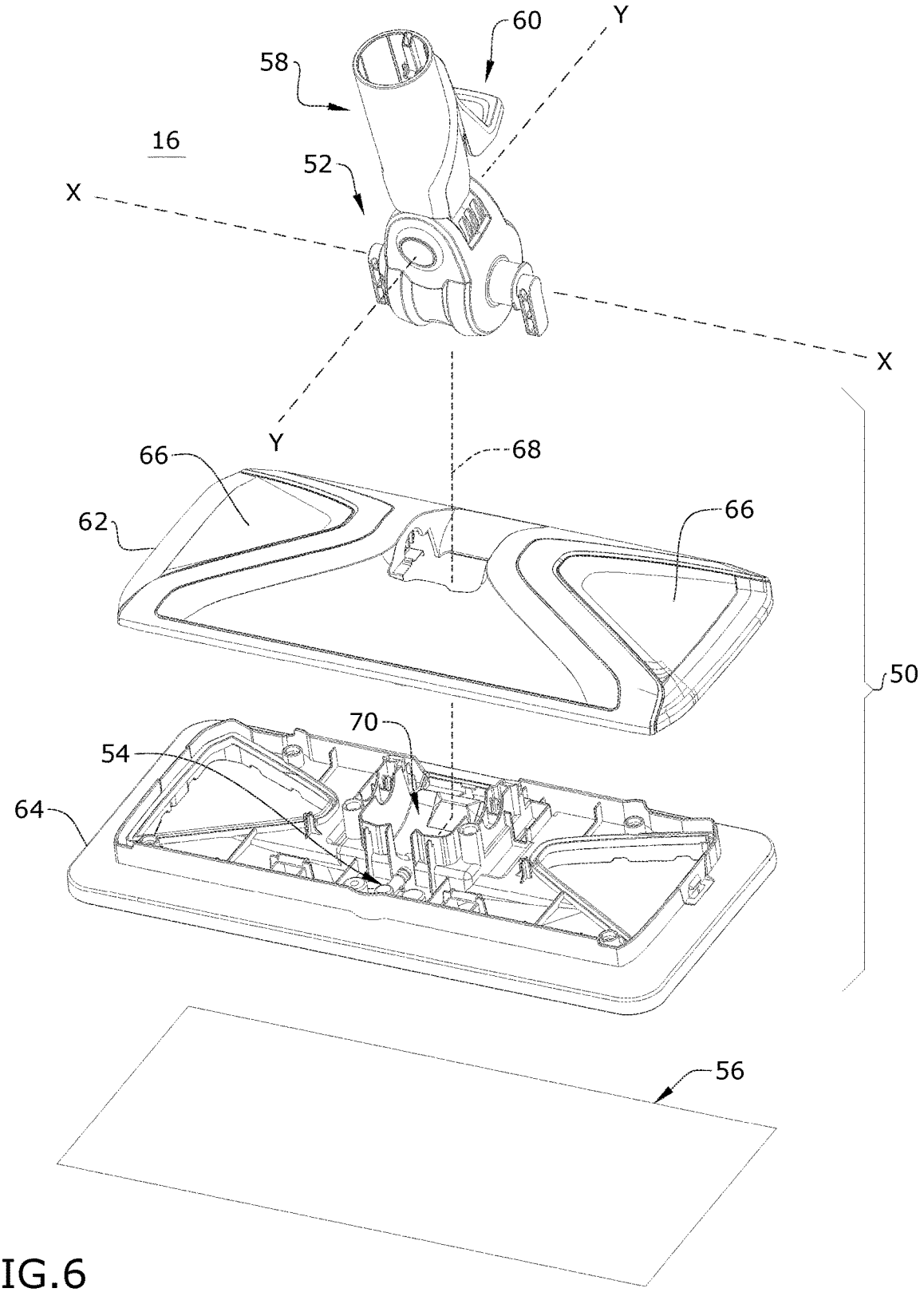
FIG. 6 is an exploded view of a base of the steam cleaning apparatus of FIG. 1.

FIG. 6 is an exploded view of the base 16 of the steam cleaning apparatus 10 of FIG. 1. The base 16 includes a base housing 50, a swivel joint, and a steam distribution nozzle 54, where the base 16 is adapted to mount a steam cleaning pad 56 on the bottom of the base housing 50, and where the base 16 can be mounted to a distal end of the handle tube 14 (FIG. 1), or alternatively, the base 16 can be mounted directly to the steam outlet conduit 36 on the steam unit 12 (FIG. 4). The swivel joint 52 couples the base housing 50 to the handle tube 14 or steam unit 12 for movement about at least two orthogonal axes of rotation X, Y. In one embodiment, the swivel joint 52 can be a universal joint. The swivel joint 52 includes a coupler 58 that receives one end of the handle tube 14 (FIG. 1) or one end of the steam unit 12 (FIG. 4), and a foot pedal 60 that is pressed to release the coupler 58 from the handle tube 14 or unit 12, respectively.

As shown herein, the base housing 50 is generally rectangular and includes an upper cover 62 and a lower cover 64 which are assembled together. Other configurations for the base housing 50 are also possible.

The steam distribution nozzle 54 is in fluid communication with the steam generator 22 of the steam unit 12 via the handle tube 14. The steam distribution nozzle 54 can be provided between the upper and lower covers 62, 64 and is adapted to direct steam through the lower cover 64 to the pad 56, which can substantially cover a lower surface of the lower cover 64. Windows 66 for viewing the cleaning pad 56 can be provided in the upper cover 62. Flexible tubing or another suitable fluid conduit 68 can deliver steam to the steam distribution nozzle 54 and can, for example, extend through the swivel joint 52 and couple with a fluid connector 69 (FIG. 14) provided inside the coupler 58. The fluid connector 69 is configured to receive the steam distribution nozzle 32 of the steam unit 12 or the steam distribution nozzle 74 of the handle tube 14 in order to fluid connect the steam distribution nozzle 54 in the base 16 with the steam delivery system of the steam unit 12. The upper and lower cover 64 can together form a cradle 70 for receiving a portion of the swivel joint 52, and the cradle 70 can partially define the first axis X of the swivel joint 52.

Figure 7:
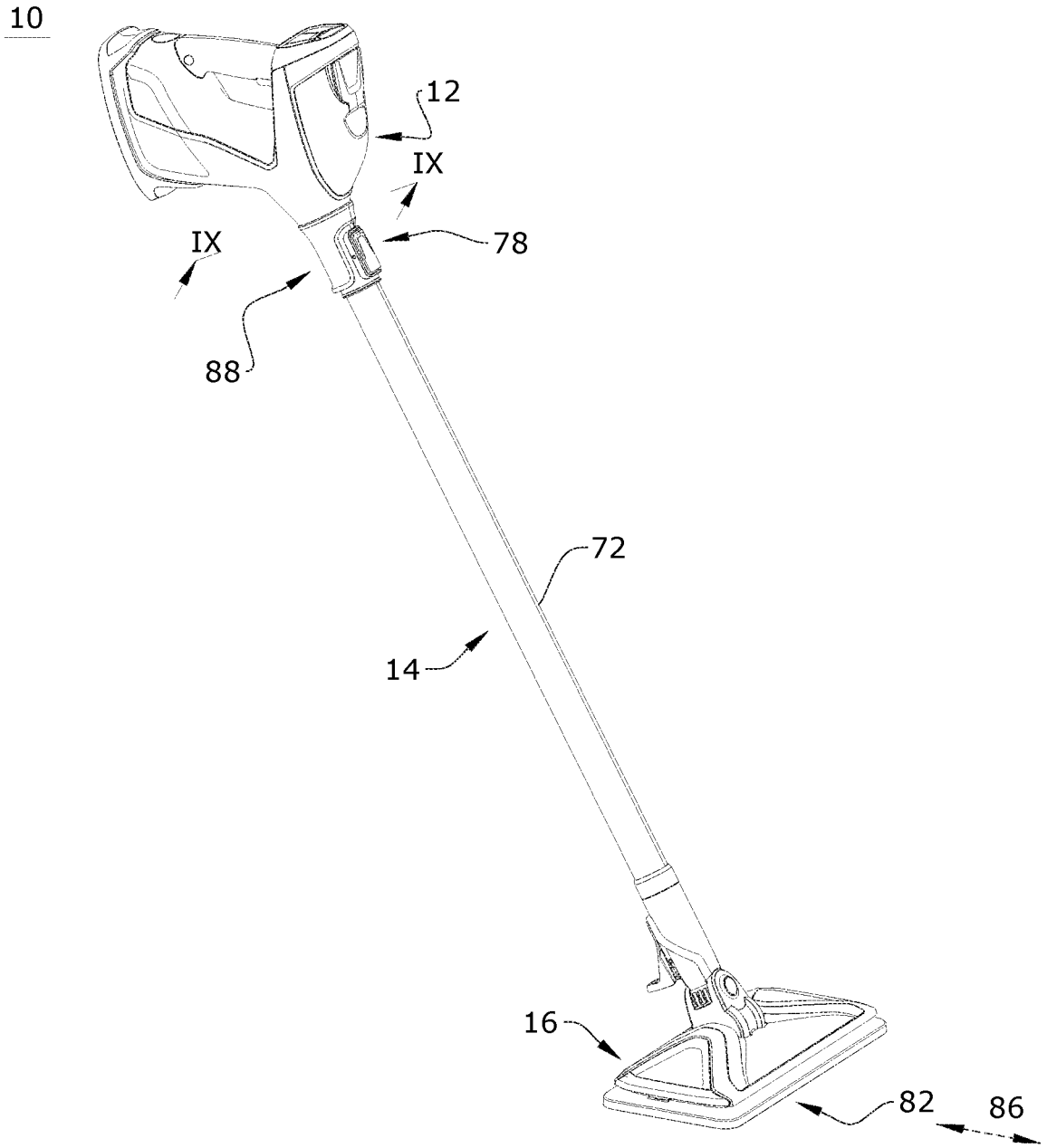
FIG. 7 is a perspective view of the steam cleaning apparatus of FIG. 1, with the base in a wide orientation.
Figure 9:
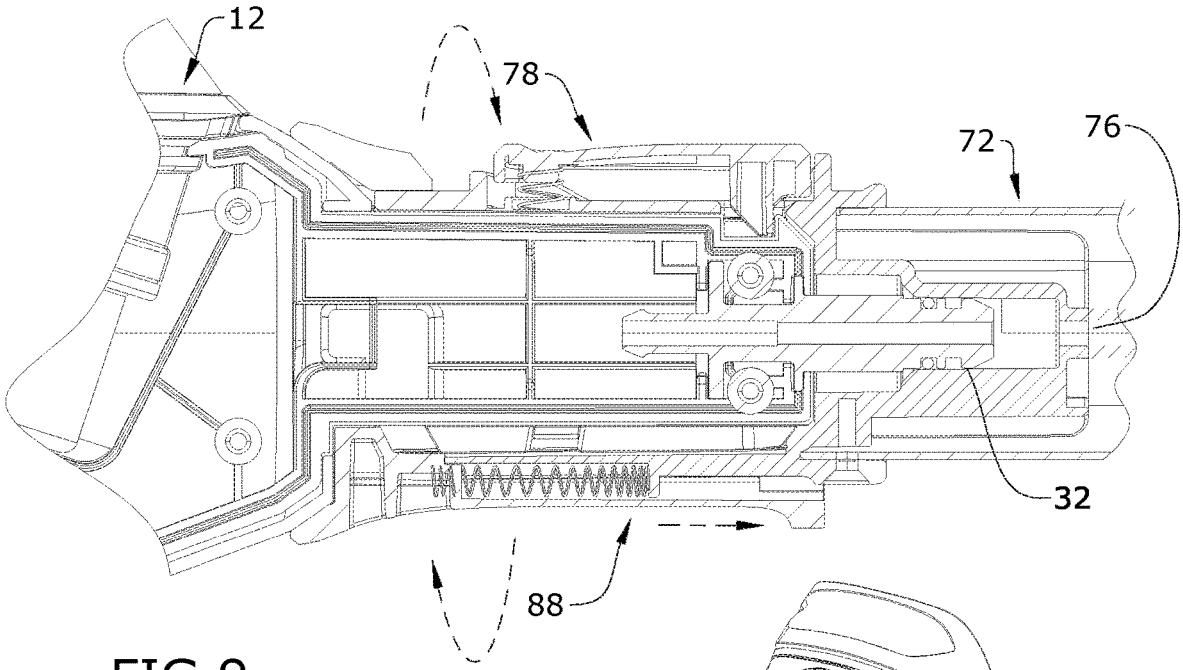
FIG. 9 is a section view through line IX-IX of FIG. 7, showing a coupling between the steam unit and the handle tube, and the operation of an indexing mechanism for moving the base between the wide and narrow orientations.
Figure 10:
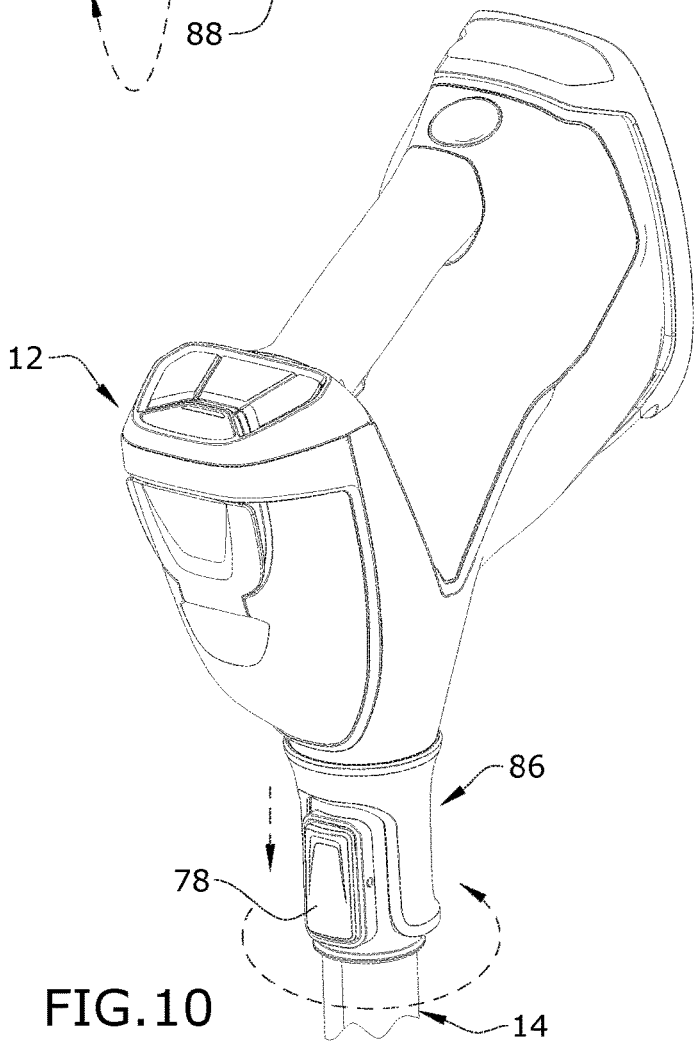
FIG. 10 is a close-up view of the coupling between the steam unit and the handle tube, showing the operation of the indexing mechanism for moving the base between the wide and narrow orientations.

Referring to FIG. 7, the handle tube 14 can comprise an elongate tubular housing 72 with a first end adapted to be attached to the steam unit 12 and a second end adapted to be attached to the base 16. The second end can further comprise a steam distribution nozzle 74 (FIG. 3) that is in fluid communication with a steam conduit 76 (FIG. 9) extending through the tubular housing 72 to the first end. Coupling the tubular housing 72 with the steam unit 12 places the steam conduit 76 in fluid communication with the steam delivery system, with the unit nozzle 32 supplying steam to the steam conduit 76, which in turn provides the steam to the handle nozzle 74.

A detent latch for mounting the handle tube 14 to the steam unit 12 is provided, and may include a pivoting button 78 carried by the handle tube 14 which engages a detent 80 (FIG. 5) provided on the outlet conduit 36 of the steam unit 12. Alternatively, the button 78 can be carried by the steam unit 12, with the detent 80 provided in the handle tube 14.

The handle tube 14 can be used with the steam unit 12 to deliver steam with or without the base 16. In the upright mode, shown in FIG. 1, the steam unit 12/handle tube 14 assembly is pivotally connected to the base 16 for directing the base 16 across the surface to be cleaned. The pistol grip 20 on the steam unit 12 can be used for maneuvering the steam mop 10 over a surface to be cleaned. When connected between the steam unit 12 and the base 16, the handle tube 14 defines a portion of the steam delivery pathway between the steam generator 22 in the steam unit 12 and the steam distribution nozzle 54 in the base 16. When used without the base 16, as shown in FIG. 3, the steam mop 10 can deliver steam to the surface from the handle nozzle 74.

Figure 8:
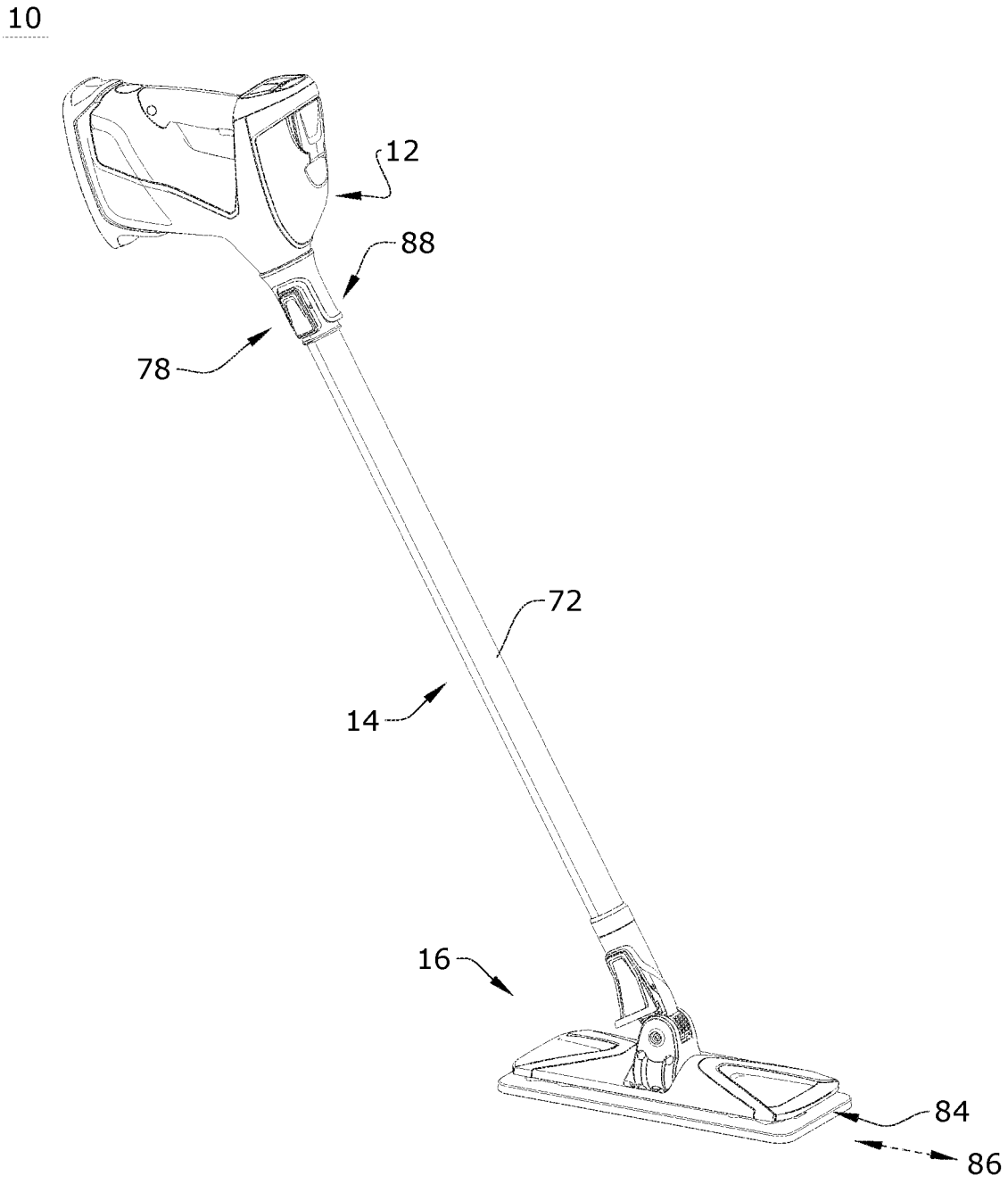
FIG. 8 is a perspective view of the steam cleaning apparatus of FIG. 1, with the base in a narrow orientation.

As shown in FIGS. 7-10, in the upright mode, the base 16 can be indexable between two different orientations relative to the steam unit 12. FIG. 7 shows the base 16 in a wide orientation, with a long side or edge 82 of the generally rectangular base 16 facing forwardly, and FIG. 8 shows the base 16 in a narrow orientation, with a short side or edge 84 of the generally rectangular base 16 facing forwardly. For a generally rectangular base 16 as shown herein, the edges 82, 84 can be generally straight sides of the base housing 50 that meet at a common vertex or corner of the base housing 50. By "generally rectangular", the base 16 can have an overall rectangular shape as shown herein, with two long edges 82 joined by two short edges 84, but the edges 82, 84 may meet at non-right angles, such as at rounded corners as shown herein, or may have opposing long and short edges 82, 84 of different length. Other shapes for the base housing 50 are possible, including those having at least one long side or edge and at least one short side or edge, and including those where the at least one long side or edge and the at least one short side or edge are non-straight but have an overall length that is different.

The indexing mechanism for flipping the orientation of the base 16 between wide and narrow allows the handle tube 14 and attached base 16 to be rotated 90 degrees so that either the short edge 84 or the long edge 82 of the base 16 can be oriented orthogonal to the direction of travel 86 of the steam mop 10 during operation. The direction of travel 86 refers to a direction of movement along an imaginary vertical plane passing through the grip 20 and handle tube 14. This allows the base 16 to be reoriented easily for cleaning areas that are particularly narrow, such as narrow space between toilet and wall or cabinets, for example, in addition to being oriented to clean a wider path in larger, more open areas. In both orientations, the swivel joint 52 allows movement about at least two axes of rotation, including front-to-back and side-to-side.

In one example illustrated in the figures, the indexing mechanism includes a spring-biased control ring or actuator sleeve 88 on the first end of the handle tube 14 that is adapted to be attached to the steam unit 12. The sleeve 88 locks the handle tube 14 in one of the two orientations relative to the steam unit 12. Pulling the sleeve 88 in a direction away from the steam unit 12 unlocks the handle tube 14 and allows the handle tube 14 to be rotated (together with the base 16) between the wide and narrow orientations. Releasing the sleeve 88 will re-lock the handle tube 14.

Figure 11:
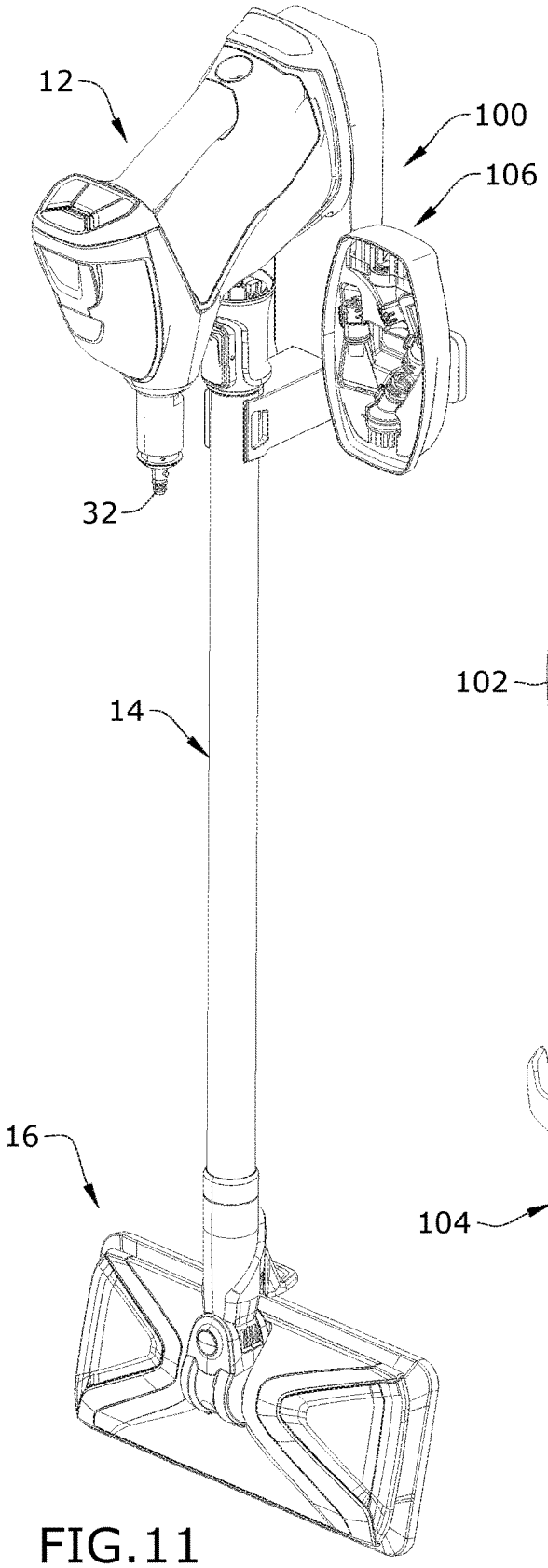
FIG. 11 is a perspective view of the steam cleaning apparatus of FIG. 1 assembled with a wall hanger unit.

Referring to FIGS. 11-12, a wall hanger unit 100 can be provided with the steam mop 10 for storing the steam unit 12, handle tube 14 and base 16. The wall hanger unit 100 can attach a wall or other vertical surface, and can have separate receivers 102, 104 for mounting the steam unit 12 and the handle tube 14, respectively. The individual receivers 102, 104 allow, for example, the steam unit 12 to be removed from the wall hanger unit 100 while the handle tube 14 remains stored on its receiver 104, and vice versa. However, the steam unit 12 receiver can alternatively mount the entire assembled steam mop 10 as well. Also, if the steam unit 12 and handle tube 14 are in use without the base 16, the base 16 can optionally be mounted on the handle receiver 104 for storage.

The steam mop 10 can optionally comprise an accessory tool caddy 106 for storing a variety of nozzle attachments or accessory tools that can be attached to the steam distribution nozzle 32 of the steam unit 12 in place of the handle tube 14 or base 16 and/or to the steam distribution nozzle 74 of the handle tube 14 in place of base 16. The tool caddy 106 can be carried on the unit housing 18, such as by being be mounted to the bottom 44 of the handheld unit 12, as shown in FIGS. 1-4, or can be coupled with the wall hanger unit 100, as shown in FIG. 11. The wall hanger unit 100 can have separate receiver 108 for mounting the tool caddy 106. The tool caddy 106 can be configured to be interchangeably coupled with the steam unit 12 or the wall hanger unit 100. When attached to the steam unit 12, a bottom 110 of the tool caddy 106 can define a substantially flat surface on which the steam unit 12 can rest in an upright position.

Some examples of interchangeable accessory tools that can attach to the steam distribution nozzles 32, 74 are shown in FIG. 12, and include, but are not limited to a flat grout cleaning brush 112 for cleaning the grout in between tiles, a flat scraping tool nozzle 114 for scraping sticky messes such as gum, sap, tar, etc., an angled nozzle 116 with a narrow outlet opening for concentrating steam in tight or confined spaces, and a round brush 118 for detailing small areas such as a stove, grill, shower, or other bathroom areas. The brushes 112, 118 have bristles, while the nozzles 114, 116 do not. Any of these tools 112-118 can be coupled with the steam distribution nozzle 32 of the steam unit 12 or the steam distribution nozzle 74 of the handle tube 14. A universal coupling such as a bayonet coupling can be provided on all tools 112-118 so that they can be interchangeably used with the steam mop 10.

Figure 13:
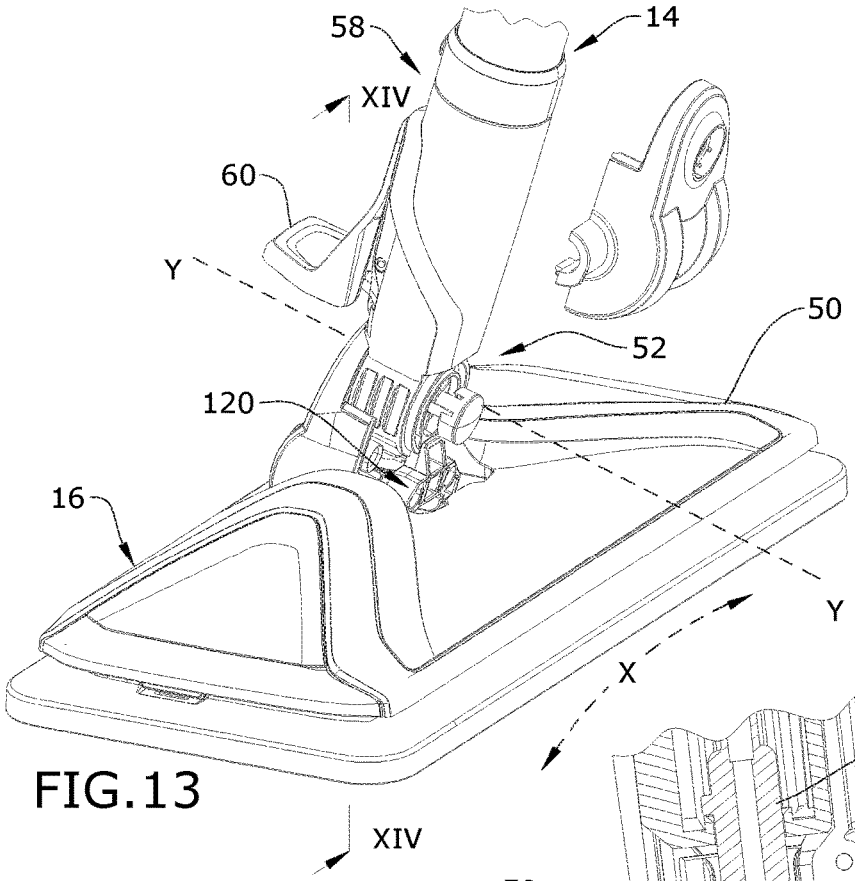
FIG. 13 is a close-up view of a swivel joint between the handle tube and the base, showing a pivot lock mechanism in a locked position.
Figure 14:
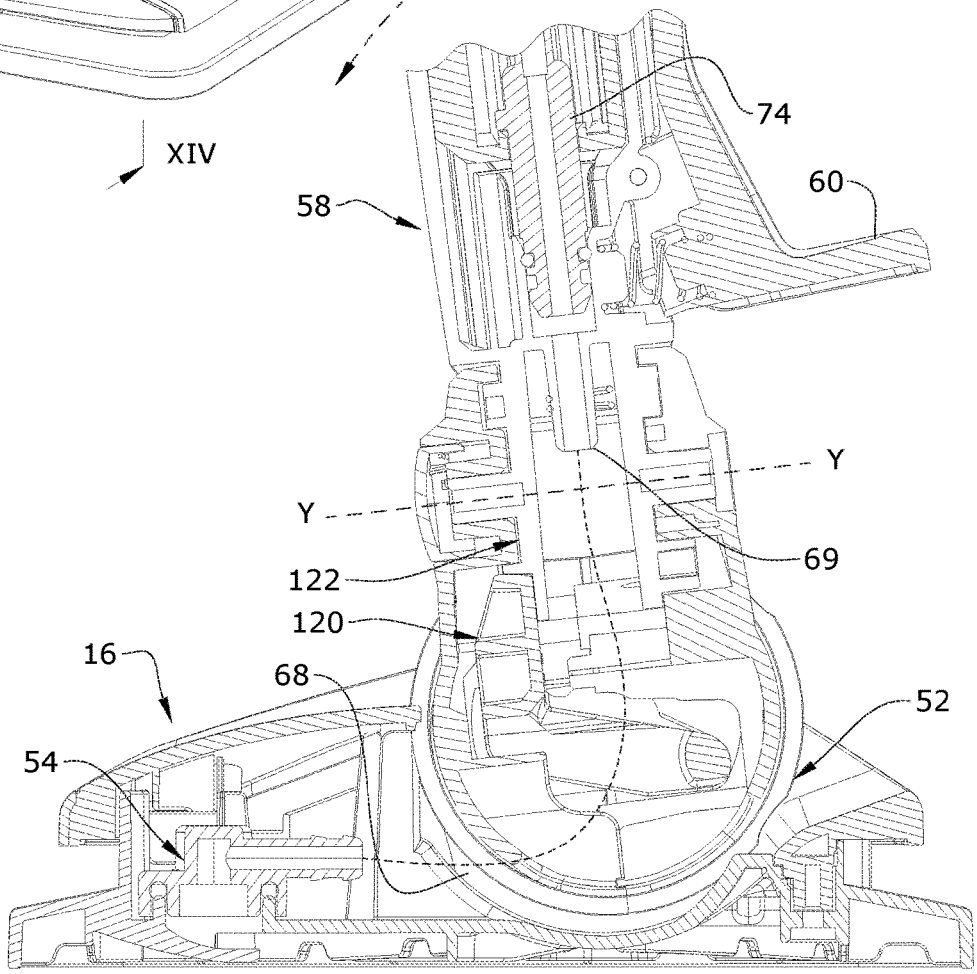
FIG. 14 is a sectional view through line XIV-XIV of FIG. 13, showing the swivel joint between the handle tube and the base, showing the pivot lock mechanism in a locked position.

FIG. 13-14 are views of a pivot lock mechanism for the steam mop 10. The pivot lock mechanism is configured to prevent side-to-side rotation of the handle tube 14 when the handle tube 14 is in the upright, detented position, which may be an over-vertical position in which the handle tube 14 is tilted slightly forwardly of vertical, relative to the surface on which the base 16 rests. The pivot lock mechanism includes a lock bar 120 that engages a detent 122 in the swivel joint 52 in the upright position. The detent 122 can, for example, be formed in a cover of the swivel joint 52 which partially defines the axis Y. The lock bar 120 can be fixed within the base housing 50, while the detent 122 moves with the coupler 58 of the swivel joint 52. The pivot lock mechanism is configured to disengage the swivel joint 52 when the handle tube 14 is reclined to an in-use position, so that the handle tube 14 is free to move side-to-side about axis Y, as well as up and down about axis X. By reclining the handle tube 14, the detent 122 moves away from the lock bar 120, freeing swivel joint 52 to move sideways, i.e. side-to-side.

Figure 15:
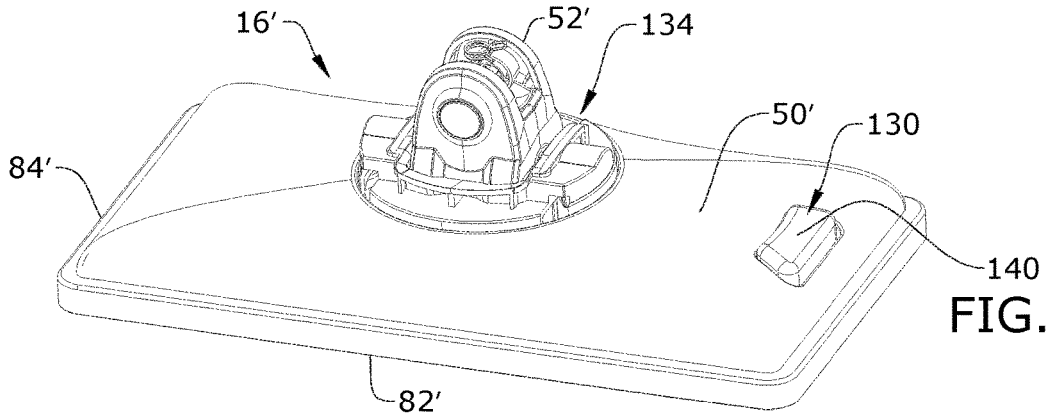
FIG. 15 is a perspective view of a base for a steam cleaning apparatus having an indexing mechanism according to a second embodiment of the invention.
Figure 16:
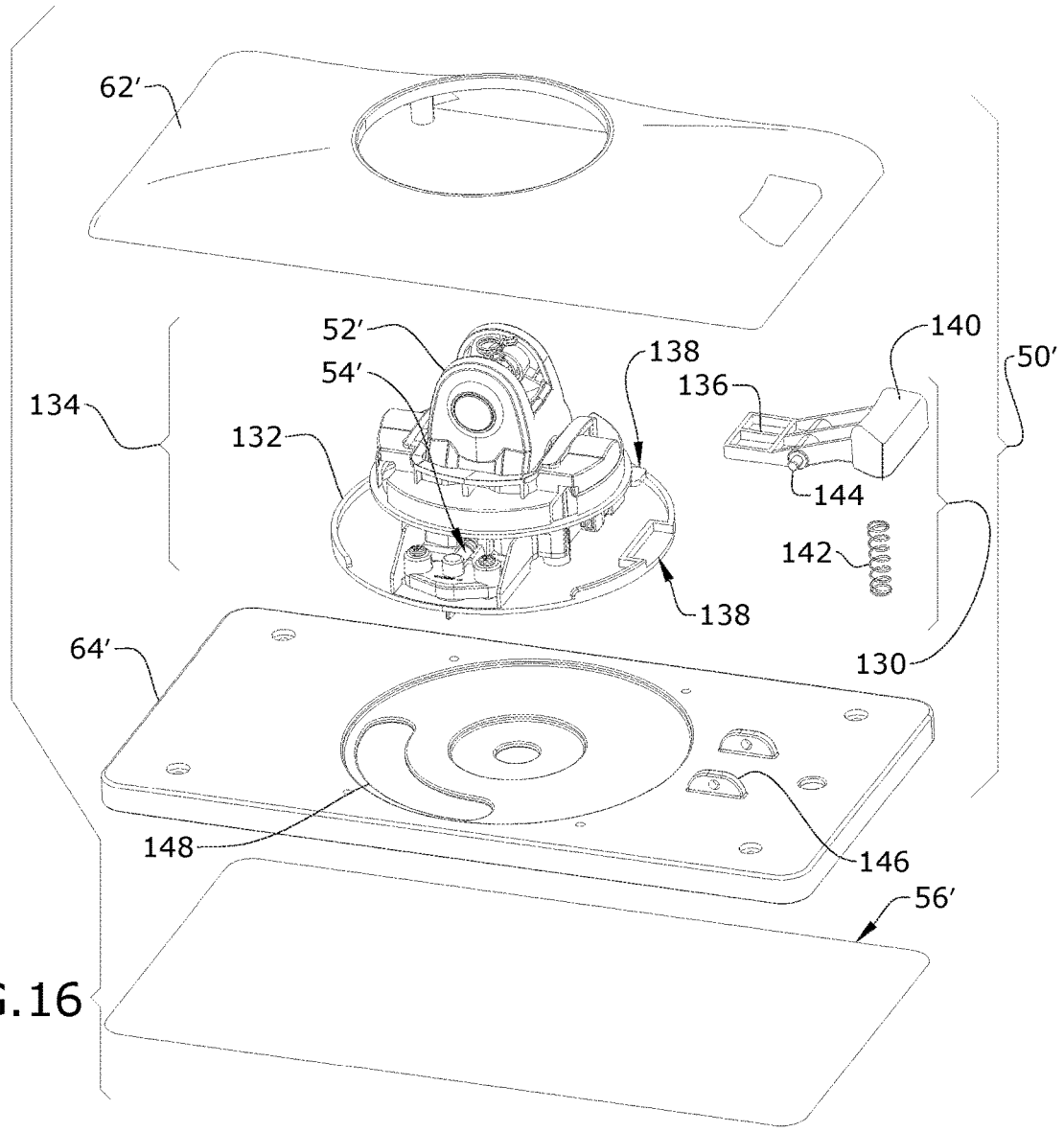
FIG. 16 is an exploded view of a base of FIG. 15.

FIGS. 15-16 show another embodiment of a base 16' and indexing mechanism for the steam mop 10, where like elements are referred by the same reference numeral bearing a prime (') symbol. Instead of rotating the entire handle tube 14 like in the previous embodiment (see FIGS. 7-8), the current embodiment of the indexing mechanism rotates the base 16' only.

The base 16' includes a base housing 50', a swivel joint 52', and a steam distribution nozzle 54', where the base 16' is adapted to mount a steam cleaning pad 56' (FIG. 16) on the bottom of the base housing 50', and where the base 16' can be mounted to a distal end of the handle tube 14 (FIG. 1), or alternatively, the base 16' can be mounted directly on the steam unit 12 (FIG. 4) as described above for the first embodiment. The swivel joint 52' couples the base housing 50' to the handle tube or steam unit 12 for movement about at least two orthogonal axes of rotation. In one embodiment, the swivel joint 52' can be a universal joint. While not shown, the swivel joint 52' can includes a coupler similar to the coupler 58 from the first embodiment that receives one end of the handle tube 14 or one end of the steam unit 12, and a foot pedal similar to the foot pedal 60 from the first embodiment that is pressed to release the coupler from the handle tube 14 or unit 12, respectively.

As shown herein, the base housing 50' includes an upper cover 62' and a lower cover 64' which are assembled together. The base housing 50' is generally rectangular, with a long edge 82' and a short edge 84'. While not shown, windows for viewing the cleaning pad 56' can be provided in the upper cover 62'. Other configurations for the base housing 50' are also possible.

The steam distribution nozzle 54' can be provided between the upper and lower covers 62', 64' and is adapted to direct steam through the lower cover 64' to the pad 56', which can substantially cover a lower surface of the lower cover 64'. Flexible tubing or another suitable fluid conduit (not shown) can deliver steam to the steam distribution nozzle 54' and can, for example, extend through the swivel joint 52' as described above with respect to the first embodiment of the base 16.

The indexing mechanism of the base 16' includes a detent latch 130 for selectively locking and unlocking the base 16' relative to the swivel joint 52' so the base housing 50' can be selectively rotated 90 degrees relative to the swivel joint 52', between wide and narrow orientations similar to those shown in FIGS. 7-8. Unlike FIGS. 7-8 however, at least a portion of the base 16' rotates relative to the steam unit 12 or handle tube 14. Thus, the steam distribution nozzle 54' is always positioned towards the leading edge of the base 16' regardless of whether the base 16' is in the wide or narrow orientation, i.e. whether the leading edge is defined by the long edge 82' or the short edge 84'. This configuration differs from the previous embodiment in which the position of the steam distribution nozzle 54 is fixed relative to the base 16, which prevents the nozzle 54 from being positioned towards the leading edge of the base 16 in both wide and narrow orientations.

The swivel joint 52' is mounted on a turret plate 132, and the base housing 50' rotates around the turret plate 132, and therefore also rotates about the swivel joint 52'. The swivel joint 52' and the turret plate 132 can collectively define a turret assembly 134 about which the base housing 50' can selectively be rotated. The steam distribution nozzle 54' is provided on the turret assembly 134, such that the base housing 50' is further selectively rotatable relative to the steam distribution nozzle 54'.

The detent latch 130 selectively locks out rotation of the turret plate 132. The detent latch 130 may include a spring-biased retainer 136 carried by the base housing 50' which engages a detent 138 provided on the turret assembly 134, such as on the turret plate 132 in the embodiment shown herein. Alternatively, the retainer 136 can be carried by the turret assembly 134, with the detent 138 provided in the base housing 50'. A foot pedal 140 can be operably coupled with the retainer 136, and can be depressed to release the retainer 136 from the detent 138, which allows the base housing 16' to rotate about the turret assembly 134. Releasing the foot pedal 140 will re-lock the detent latch 130.

A spring 142 biases the retainer 136 toward the detent 138. As shown herein, the spring 142 can specifically bias the foot pedal 140 upwardly away from the upper cover 62' of the base housing 50'. This biases the retainer 136 downwardly due to a pivotal coupling between the foot pedal 140 and the base housing 50' which is defined by a pivot axle 144 operably coupled between the foot pedal 140 and the retainer 136 and a pivot axle receiver 146 provided on the base housing 50', such as on the lower cover 64'. As shown here, the pivot axle 144, foot pedal 140, and retainer 136 may be molded together as one piece, although other configurations are possible.

It is noted that two detents 138 corresponding to the wide and narrow orientations can be provided in the turret assembly 134. As shown herein, the two detents 138 can be provided approximately 90 degrees apart, in correspondence with the wide and narrow orientations.

In the embodiment shown herein, the turret plate 132 also mounts the steam distribution nozzle 54'. The nozzle 54' can be aligned with a steam outlet opening 148 in the bottom of the base housing 50', such as in the lower cover 64', for dispensing steam to the cleaning pad 56'. The steam outlet opening 148 can be elongated or oversized to accommodate for the movement of the base housing 50' relative to the nozzle 54'. As shown herein, the steam outlet opening 148 can be arcuate in shape to accommodate for the rotation of the base housing 50' relative to the turret assembly 134.

FIGS. 17-22 show a third embodiment of an indexing mechanism for the steam mop 10, where like elements are referred by the same reference numeral bearing a double prime (") symbol. The third embodiment of the indexing mechanism includes a keyed interface coupling between the handle tube 14" and the steam unit 12" that permits the handle tube 14" to be mounted to the steam unit 12" in any of three positions, so that one long side 82" of the base 16" can face forward, or either short side 84" of the base 16" can face forward. The handle tube 14" can be mounted to the steam unit "straight" or the handle tube 14" can be rotated by 90 degrees clockwise or counterclockwise prior to being locked to the steam unit 12".

Figure 20:
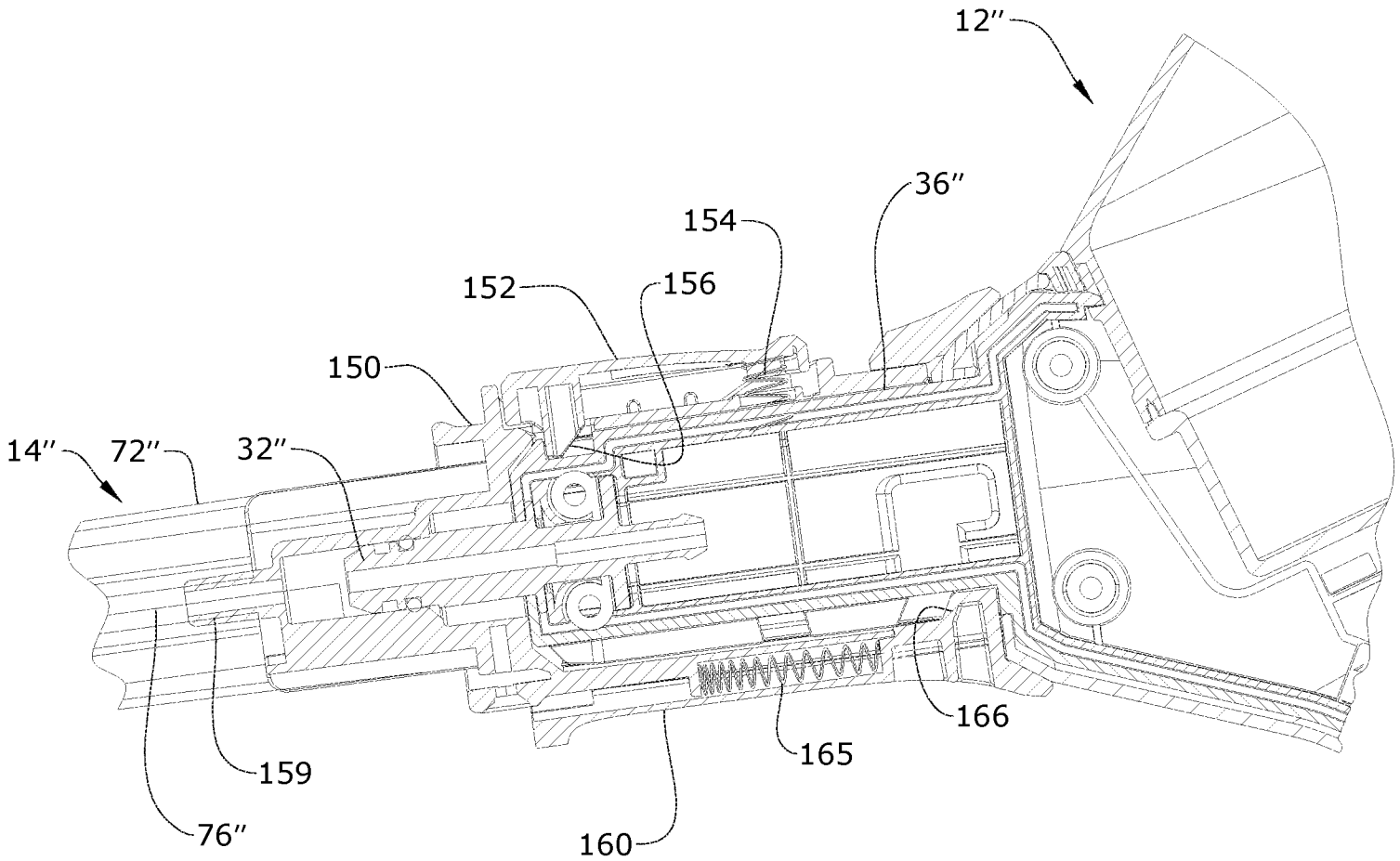
FIG. 20 is a section view through line XX-XX of FIG. 17, showing a coupling between the steam unit and the handle tube.
Figure 21:
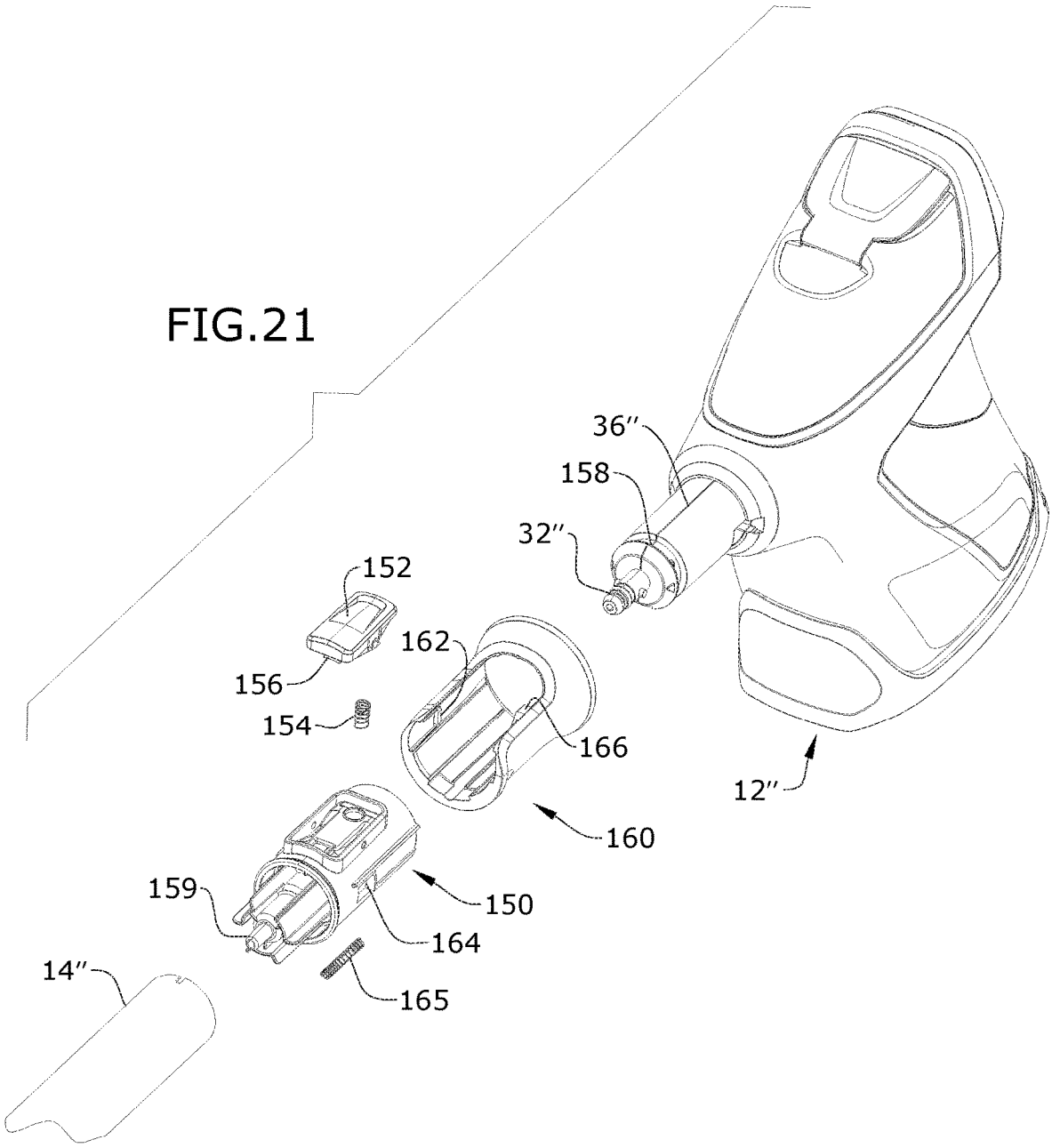
FIG. 21 is a top perspective exploded view of the coupling between the steam unit and the handle tube for the steam cleaning apparatus of FIG. 17.

Referring to FIG. 20, the handle tube 14" can comprise an elongate tubular housing 72" with a first end adapted to be attached to the steam unit 12" and a second end adapted to be attached to the base 16". The second end can further comprise a steam distribution nozzle (not shown) that is in fluid communication with a steam conduit 76" extending through the tubular housing 72" to the first end. Coupling the tubular housing 72" with the steam unit 12" places the steam conduit 76" in fluid communication with the steam delivery system, with the unit nozzle 32" supplying steam to the steam conduit 76", which in turn provides the steam to the base 16".

The first end of the handle tube 14" comprises a tube insert 150, which is press fit into the handle tube 14", for selectively connecting and releasing the handle tube 14" to the steam outlet conduit 36" of the steam unit 12" in various positions. A detent latch for mounting the handle tube 14" to the steam unit 12" is provided, and may include a release button 152 on the tube insert 150, which can be biased by a spring 154 and has a detent 156 that engages a recessed catch 158 on the steam outlet conduit 36" on the steam unit 12", near the steam distribution nozzle 32". The tube insert 150 can further include a steam connector 159 which is received in an end of the steam conduit 76". Upon coupling the tubular housing 72" with the steam unit 12", the steam distribution nozzle 32" is press fit into the tube insert 150 in fluid communication with the steam connector 159.

A spring-biased control ring or actuator sleeve 160, shown herein as comprising a tubular housing, is mounted to the tube insert 150 via detent hooks 162 on an inner wall of the tubular housing that are received within corresponding recesses 164 on an outer wall of the tube insert 150. A spring 165 can bias the sleeve 160 toward the steam unit 12", longitudinally with respect to the handle tube 14".

Figure 22:
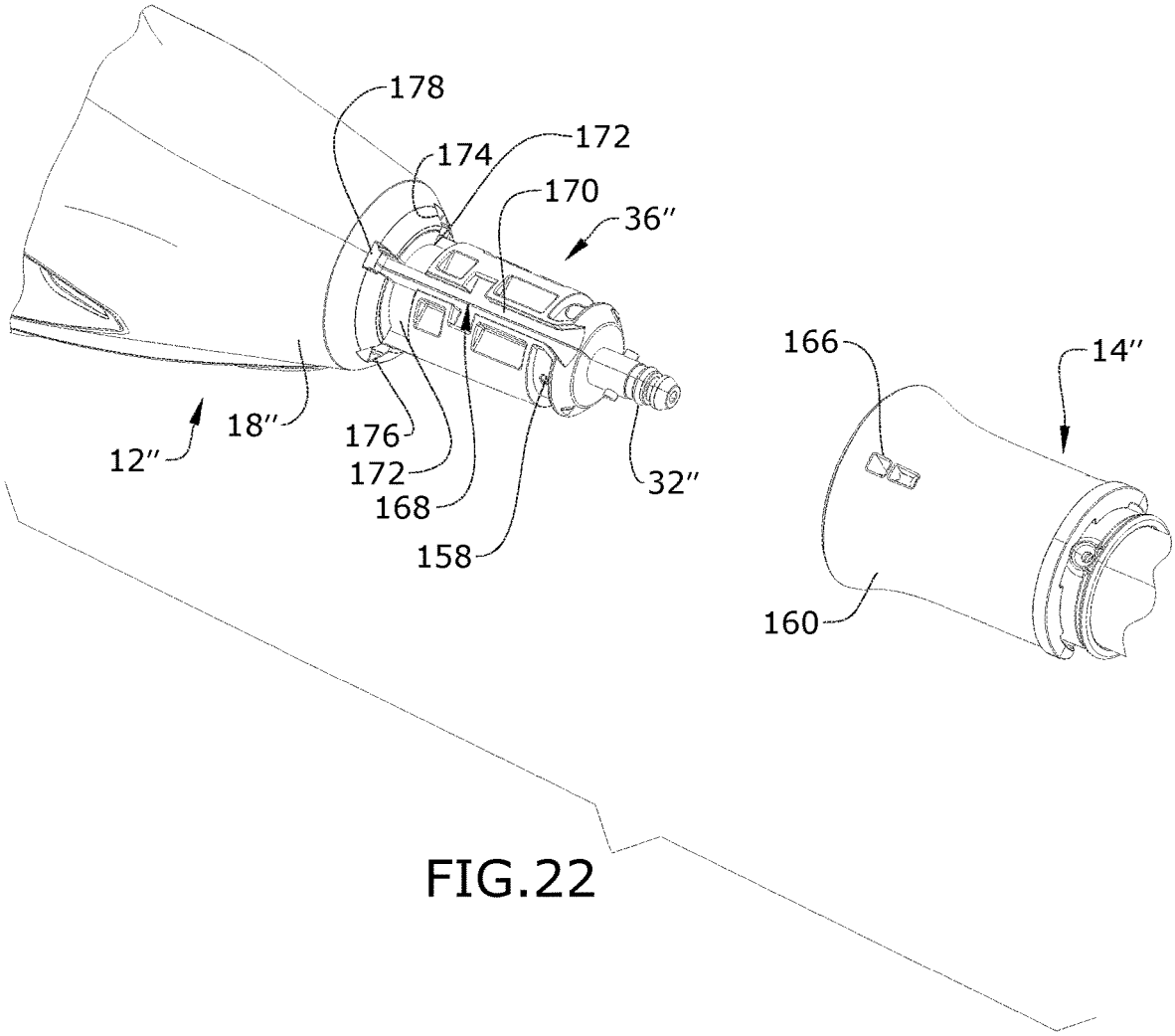
FIG. 22 is a bottom perspective exploded view of the coupling between the steam unit and the handle tube for the steam cleaning apparatus of FIG. 17.
Figure 23:
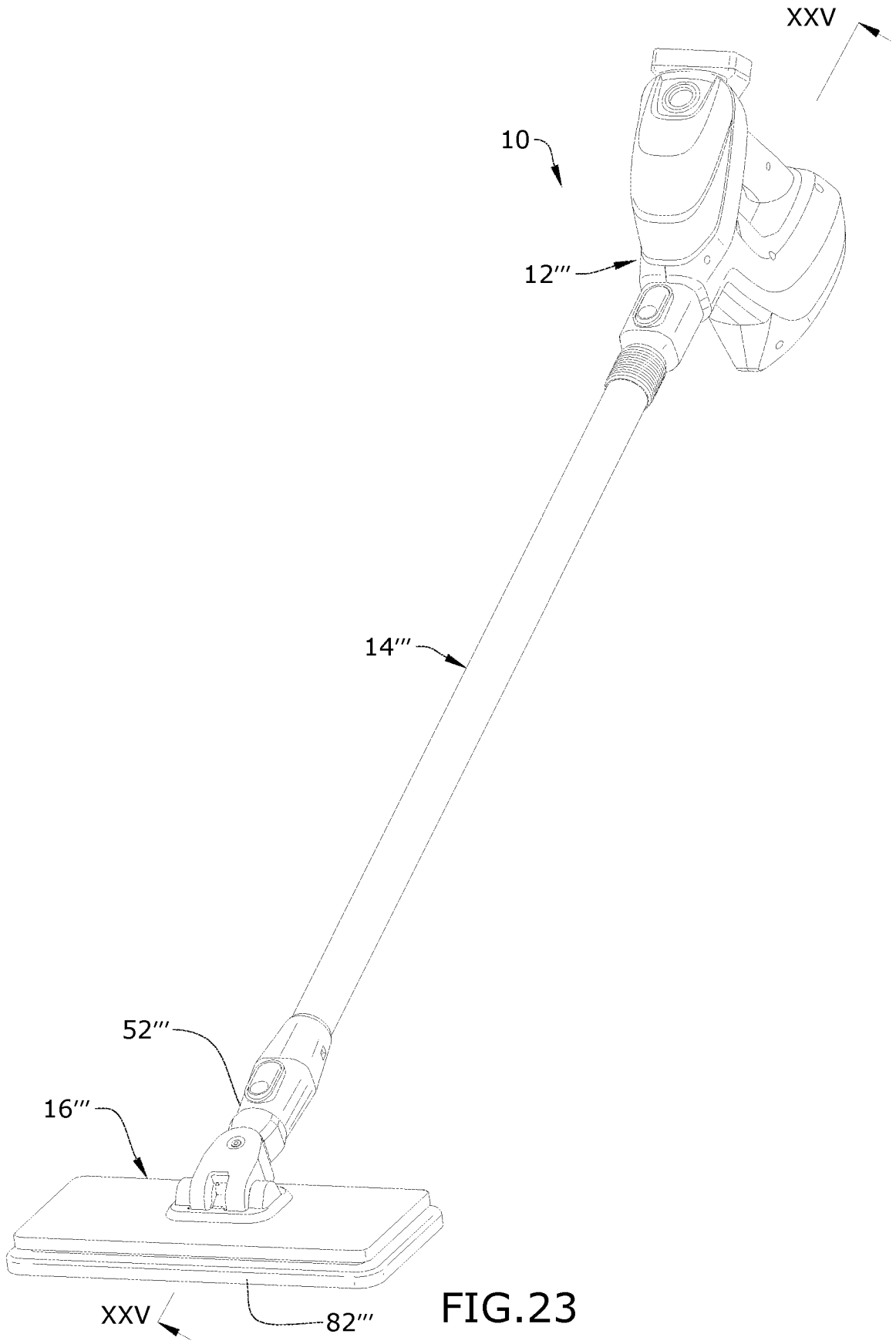
FIG. 23 is a perspective view of the steam cleaning apparatus with an indexing mechanism according to a fourth embodiment of the invention, with the base in a wide orientation.
Figure 24:
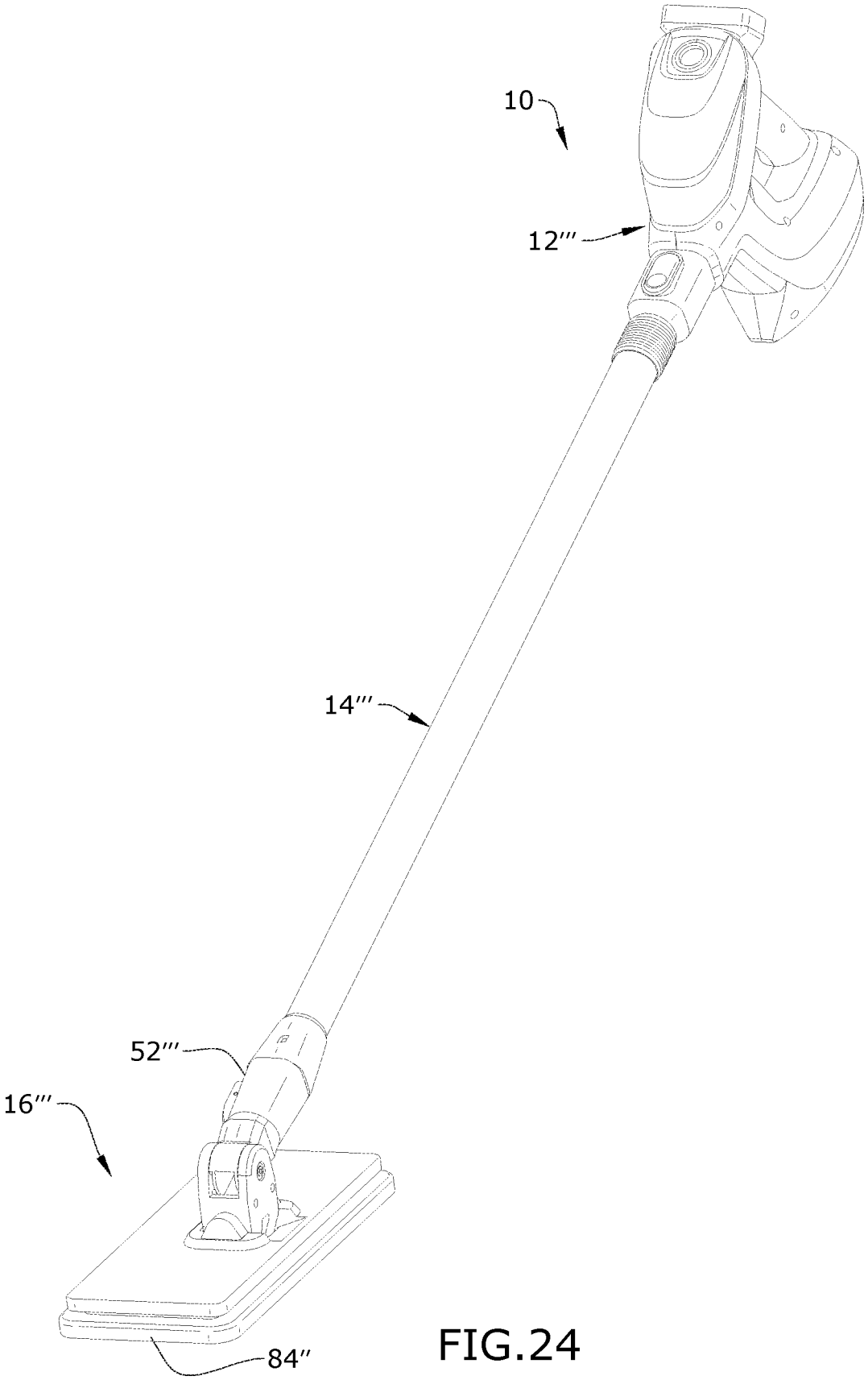
FIG. 24 is a perspective view of the steam cleaning apparatus of FIG. 23, with the base in a narrow orientation.

Referring additionally to FIG. 22, an upper rim of the sleeve 160 comprises a lug 166, for engaging a recessed track 168 on the steam outlet conduit 36". The track 168 shown herein comprises a T-shape, with an axial track portion 170 joined with a circumferential track portion 172, where the axial track portion 170 extends generally parallel to a longitudinal axis of the elongate tubular housing 72" and the circumferential track portion 172 extends circumferentially about the longitudinal axis of the elongate tubular housing 72". A first and second end recess 174, 176 are formed in the steam unit housing 18" at the ends of the circumferential track portion 172, which corresponds to a 90 degree offset around the perimeter of the steam outlet conduit 36" from the axial track portion 170. A third end recess 178 is axially aligned with the axial track portion 170. The end recesses 174, 176, 178 are sized to receive the lug 166 on the sleeve 160, which locks the handle tube 14" in one of the wide or narrow orientations.

Figure 17:
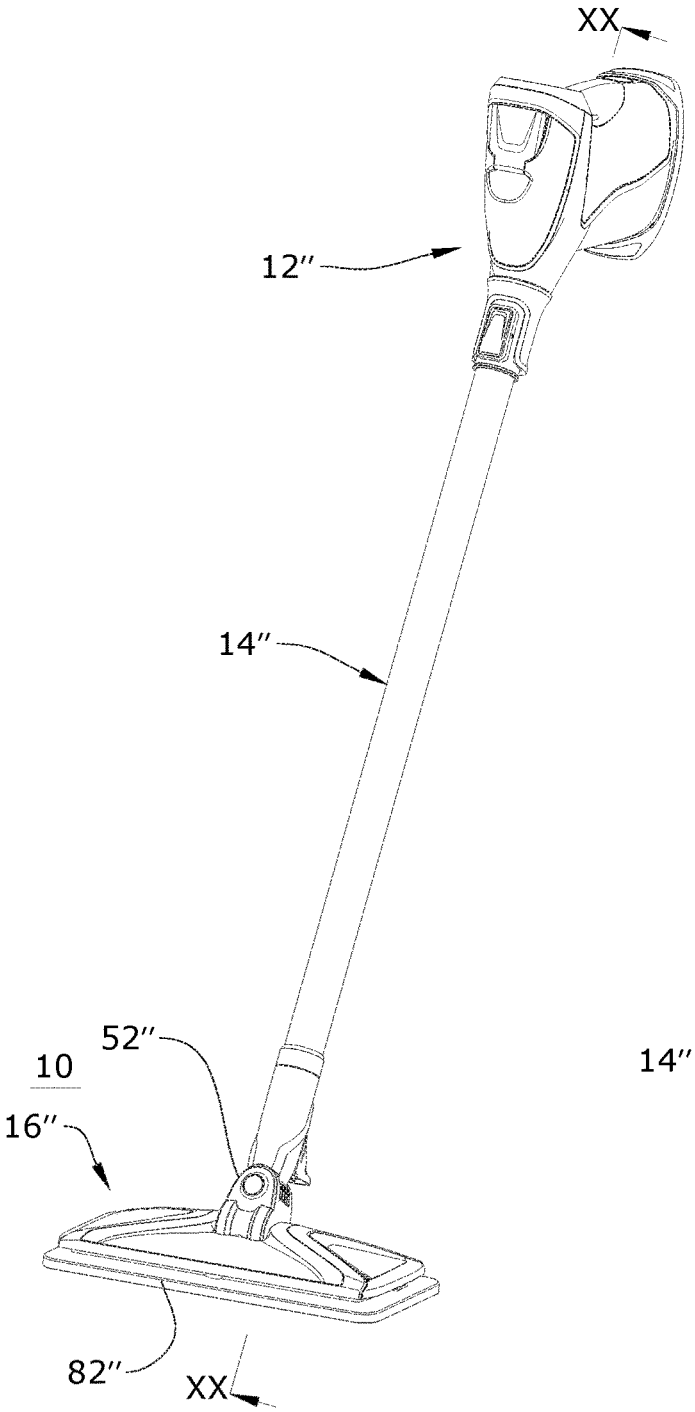
FIG. 17 is a perspective view of the steam cleaning apparatus with an indexing mechanism according to a third embodiment of the invention, with the base in a wide orientation.
Figure 18:
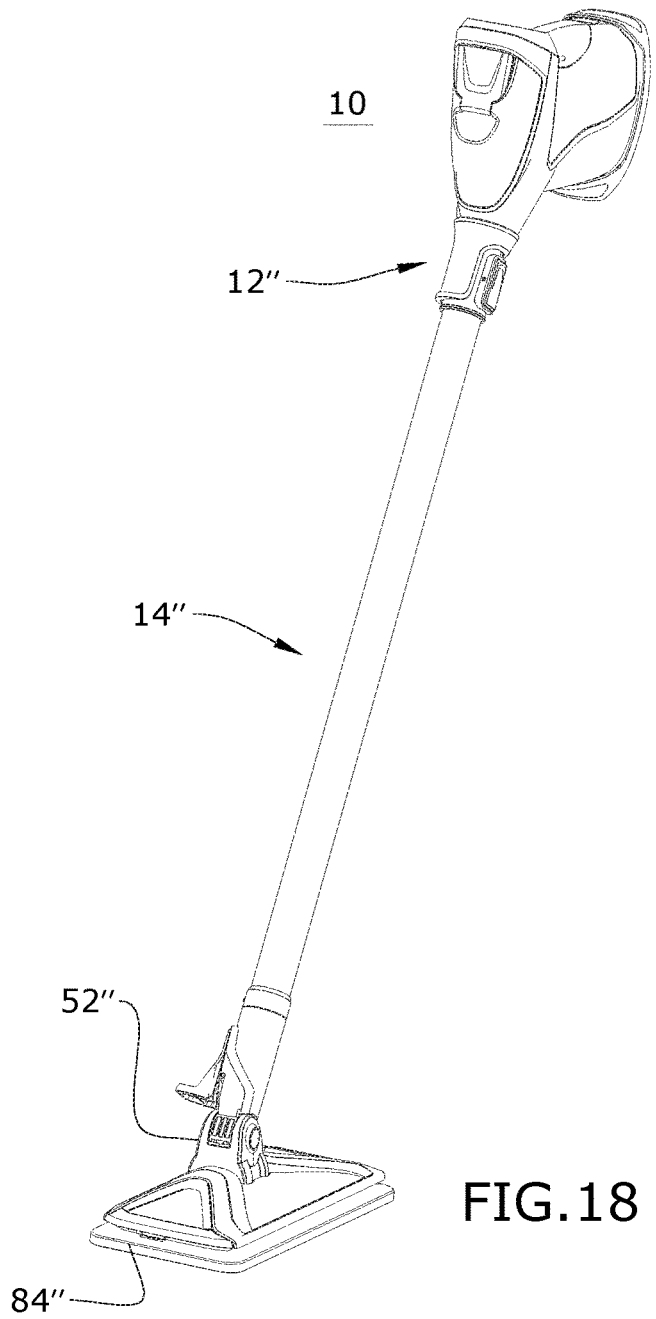
FIG. 18 is a perspective view of the steam cleaning apparatus of FIG. 17, with the base in a first narrow orientation.
Figure 19:
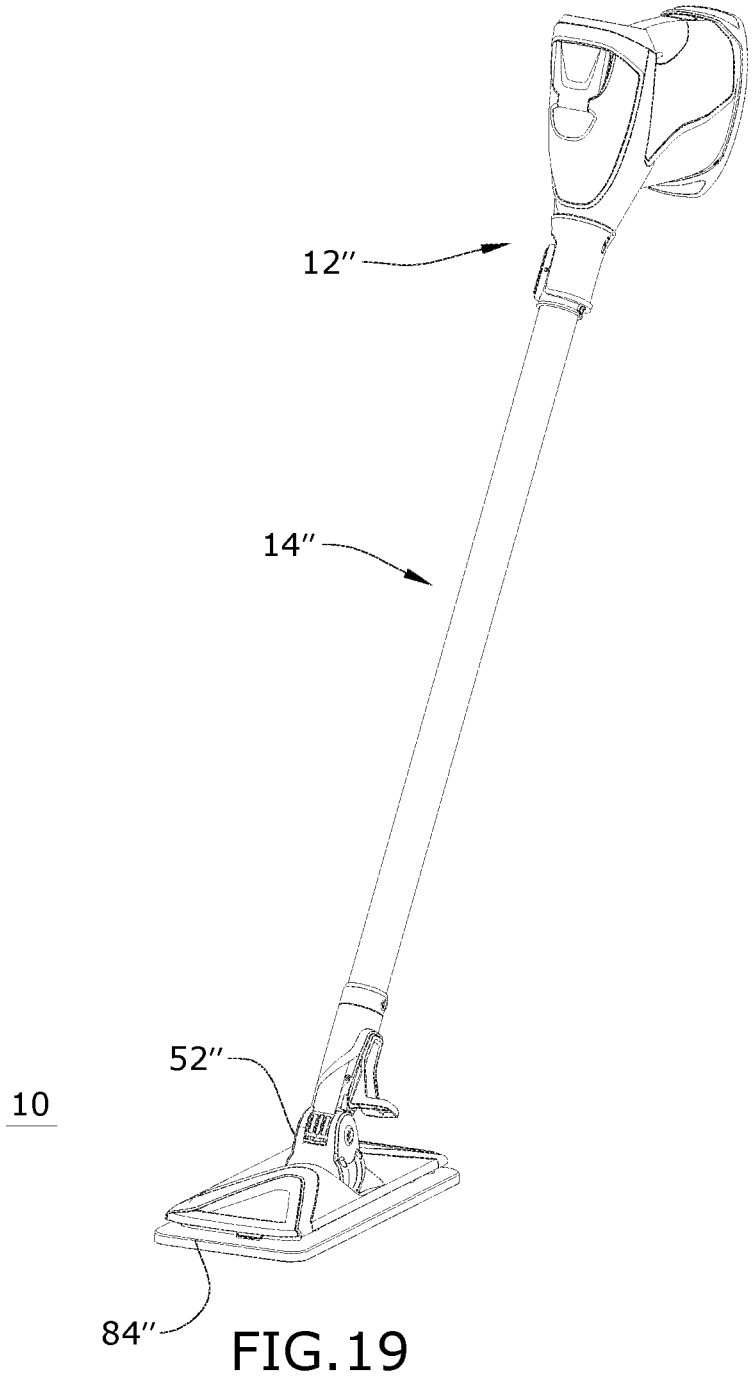
FIG. 19 is a perspective view of the steam cleaning apparatus of FIG. 17, with the base in a second narrow orientation.

In use, the rotational position of the handle tube 14" (and thus, the base 16") can be adjusted as follows: To orient the first end of the handle tube 14" at 0 degrees, i.e. in the wide orientation where the long edge 82" of the base 16" faces forward, a user aligns the lug 166 with the track 168 and slides the lug 166 up the axial track portion 170 until the lug 166 is received in the third end recess 178, whereupon the detent 156 on the release button 152 will engage the catch 158 on the steam outlet conduit 36", locking the handle tube 14" to the steam unit 12". To rotate the handle tube 14", the user depresses the release button 152, slides the lug 166 out of the end recess 178 and into the circumferential track portion 172 by twisting the tube 14" clockwise or counterclockwise so the lug 166 slides to either of the first or second end recess 174, 176. The user then slides the lug 166 into the desired end recess 174, 176 at which point the release button detent 156 engages the catch 158 and locks the handle tube 14" to the steam unit 12" at 90 degrees clockwise or counterclockwise, i.e. to one of the narrow orientations where one of the short edges 84" of the base 16" faces forward. As shown in FIGS. 17-19, rotating the handle tube 14" allows the user to orient either the long edge 82" or either short edge 84" of the base 16" to face forward, depending on the cleaning need.

FIGS. 23-29 show a fourth embodiment of an indexing mechanism for the steam mop 10, where like elements are referred by the same reference numeral bearing a triple prime (‴) symbol. The fourth embodiment of the indexing mechanism includes a spring-biased control ring or actuator sleeve on the first end of the handle tube 14‴ that is adapted to be attached to the steam unit 12‴ and that permits the handle tube 14‴ to be rotated (together with the base 16‴) between a wide orientation where the long side 82‴ of the base 16‴ faces forward or a narrow orientation where the short side 84‴ of the base 16‴ faces forward.

Figure 25:
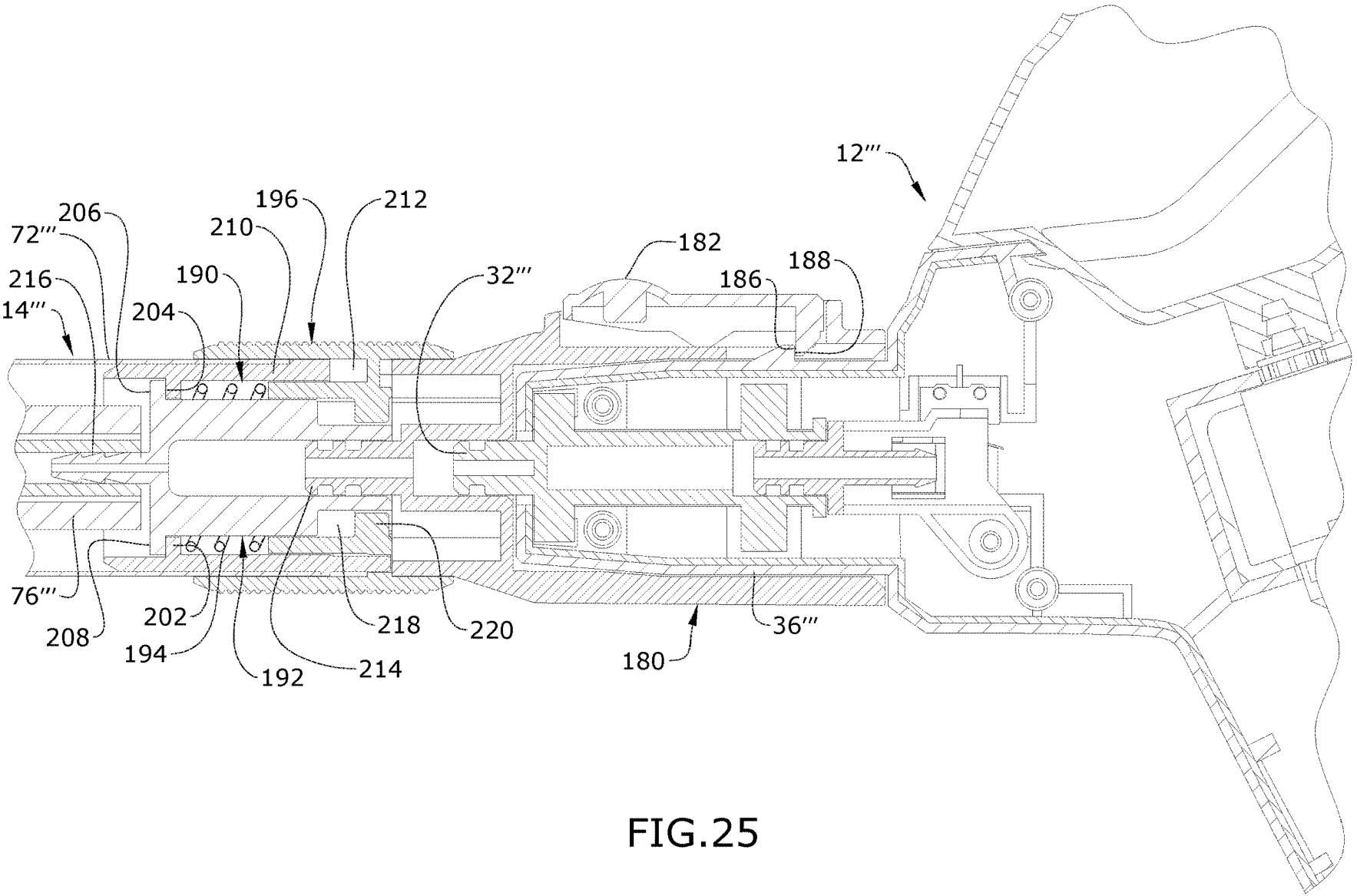
FIG. 25 is a section view through line XXV-XXV of FIG. 23, showing a coupling between the steam unit and the handle tube.
Figure 26:
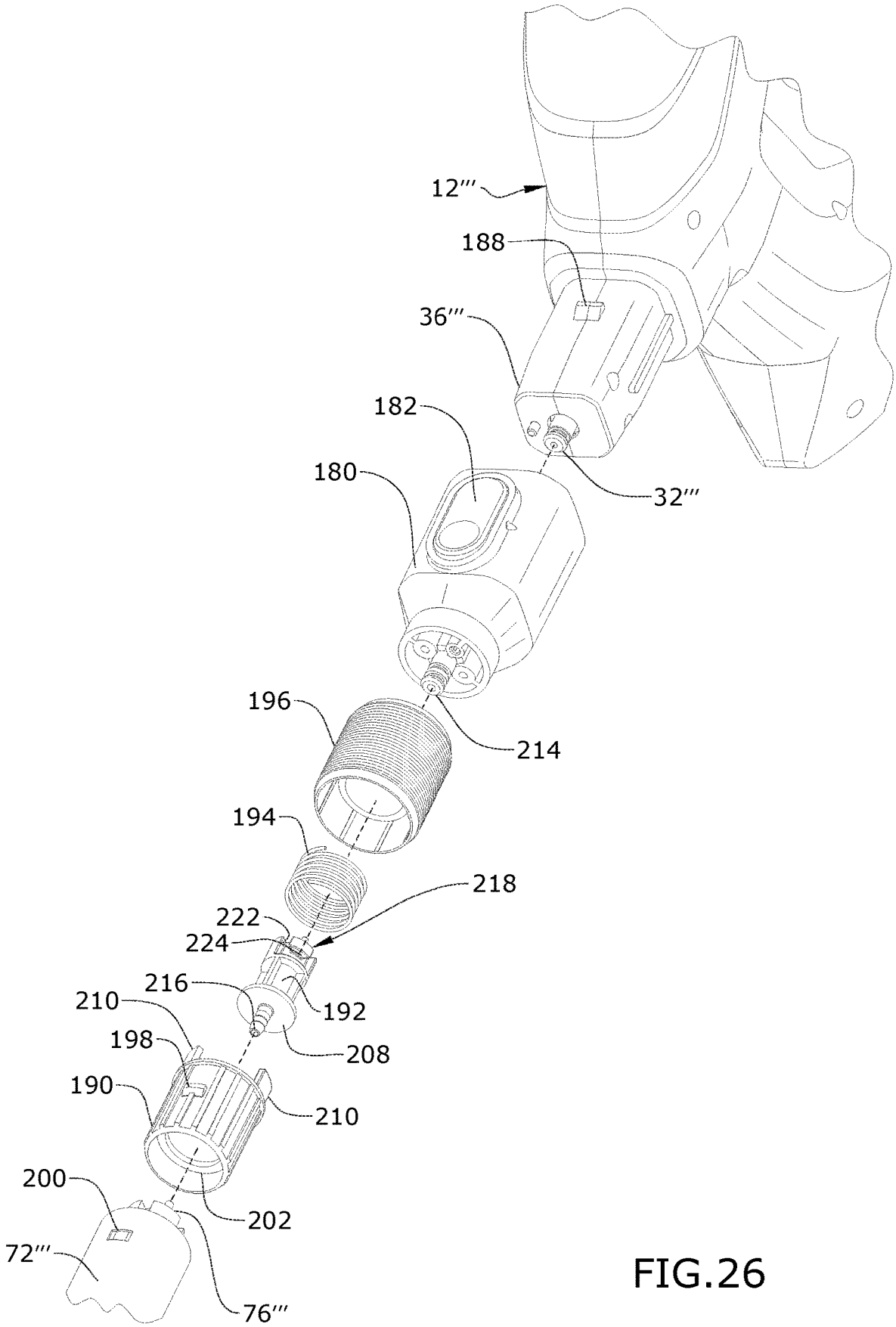
FIG. 26 is a top perspective exploded view of the coupling between the steam unit and the handle tube for the steam cleaning apparatus of FIG. 23.

Referring to FIG. 25, the handle tube 14‴ can comprise an elongate tubular housing 72‴ with a first end adapted to be attached to the steam unit 12‴ and a second end adapted to be attached to the base 16‴. The second end can further comprise a steam distribution nozzle (not shown) that is in fluid communication with a steam conduit 76‴ extending through the tubular housing 72‴ to the first end. Coupling the tubular housing 72‴ with the steam unit 12‴ places the steam conduit 76‴ in fluid communication with the steam delivery system, with the unit nozzle 32‴ supplying steam to the steam conduit 76", which in turn provides the steam to the base 16‴.

A detent latch for mounting the handle tube 14‴ to the steam unit 12‴ can be provided, and may be provided via an adapter housing 180 provided at a first or proximal end of the handle tube 14‴. The adapter housing 180 includes a pivoting release button 182 biased by a spring 194 for selectively securing the handle tube 14‴ to the steam outlet conduit 36‴ on the steam unit 12‴. The release button 182 includes a catch 186 for retaining a detent 188 on the steam outlet conduit 36‴. When the release button 182 is depressed, the catch 186 disengages from the detent 188 and the entire handle tube 14‴ can be removed from the steam unit 12‴.

The indexing mechanism allows the handle tube 14‴ and base 16‴ to be rotated about a longitudinal axis of the tubular housing 72", relative to the adapter housing 180 and steam unit 12‴, which remain stationary. In one embodiment, the indexing mechanism can include a tube insert 190, a connector 192, a compression spring 194, and an actuator sleeve 196.

The tube insert 190 comprises a cylindrical body that is configured to retain the connector 192 within the handle tube 14‴. The tube insert 190 has detents 198 on an outer portion that are received within detent openings 200 in the tubular housing 72‴. The tube insert 190 is configured to be press fit securely into the tubular housing 72". An inner flange 202 on a lower portion of the tube insert 190 comprises a proximal flange surface 204 and a distal flange surface 206, the proximal flange surface 204 oriented towards the first end of the handle tube 14‴ and the distal flange surface 206 oriented towards the second end of the handle tube 14‴. The distal flange surface 204 mates with an outer flange 208 on the connector 192 such that the connector 192 is retained within the tubular housing 72‴. A plurality of tabs 210 extend proximally from a rim of the tube insert 190 and are received within slots 212 formed within the sleeve 196. The tabs 210 engage the slots 212 in the sleeve 196, which can selectively induce rotation of the tube insert 190, including the handle tube 14''' fixed thereto when a user twists the sleeve 196 to index the base 16''' relative to the steam unit 12'''.

The distal end of the adapter housing 180 is secured to a proximal end of the connector 192 by fasteners (not shown) such that the position of the connector 192 relative to the adapter housing 180 and steam unit 12''' is fixed. Steam conduits 214, 216 formed within the adapter housing 180 and connector 192, respectively, are fluidly connected to the steam distribution nozzle 32''' on the steam unit 12''' such that a continuous steam flow path extends from the steam outlet conduit 36''' on the steam unit 12''' through the adapter housing 180, connector 192 and through the steam conduit 76''' inside the handle tube 14''' to a steam distribution nozzle (not shown) on the base 16''', but which can be identical to the steam distribution nozzle 54, 54', 54'' of any of the previous embodiments.

The compression spring 194 is mounted around the connector 192 and is sandwiched between the proximal flange surface 204 on the tube insert 190 and a rib (not shown) inside the sleeve 196. The compression spring 194 biases the sleeve 196 towards the steam unit 12'''.

The connector 192 further comprises a pair of U-shaped tracks 218 on an outer portion thereof that receive lugs 220 formed on an inner wall of the sleeve 196. Each U-shaped track 218 comprises a pair of axial track portions defining end recesses 222 and a circumferential track portion 224 joining the end recesses 222. The lugs 220 on the sleeve 196 are configured to slide through the axial track portions when the sleeve 196 is pushed distally, or away from the steam unit 12'', and returns upwardly under the force of the compression spring 194. When pushed distally, the sleeve 196 can be twist about the longitudinal axis of the handle tube 14''' to slide the lugs 220 through the circumferential track portions 224 to move the lugs 220 into alignment with either end recesses 222 of the tracks 218.

Figure 27:
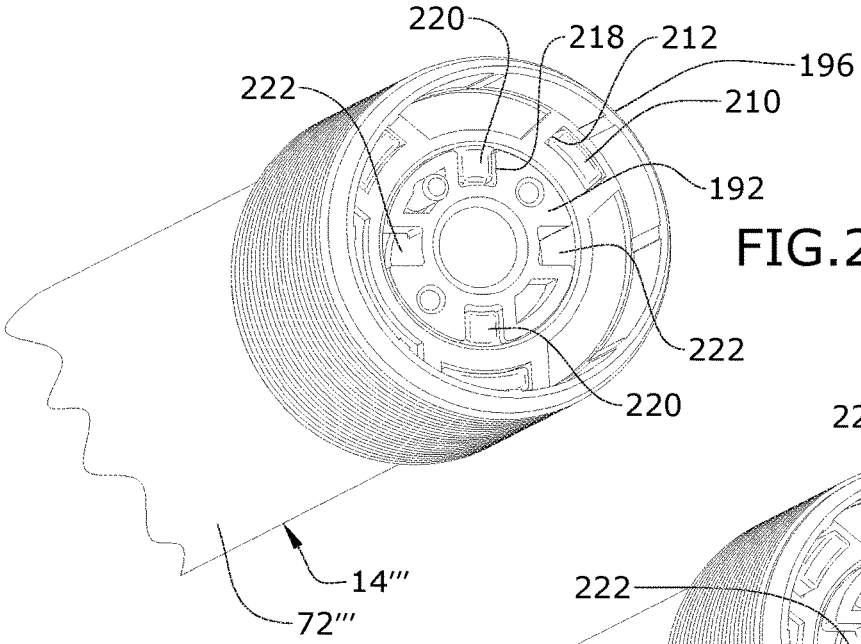
FIGS. 27-29 are rear perspective views of the coupling between the steam unit and the handle tube for the steam cleaning apparatus of FIG. 23 showing the operation of the indexing mechanism.
Figure 28:
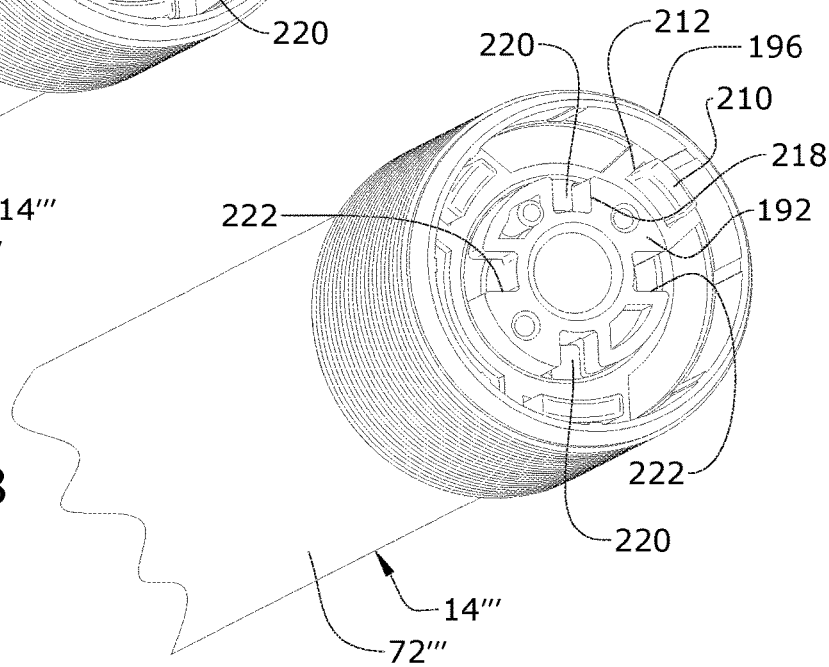
Figure 29:
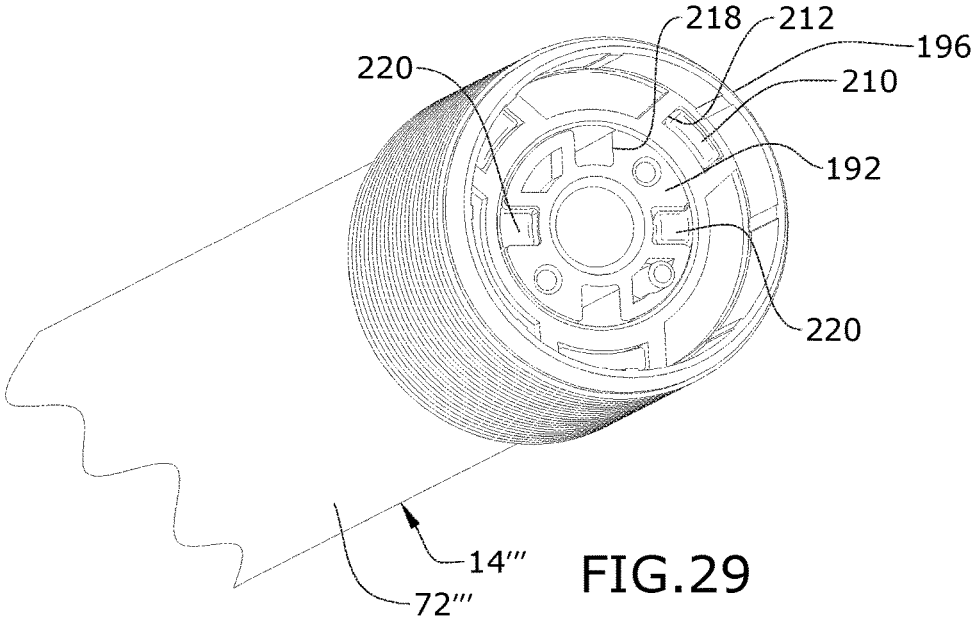

FIGS. 27-29 are rear perspective views showing the actuator sleeve 196 in various positions during the indexing. In FIGS. 27-29, the adapter housing 180 and steam unit 12''' have been removed for clarity. FIG. 27 shows the actuator sleeve 196 in a proximal or home position, as shown in FIG. 25, where the sleeve 196 is biased by the spring 194 toward the adapter housing 180 and steam unit 12''' and the handle tube 14'' is in the wide orientation. FIG. 28 shows the actuator sleeve 196 in a retracted position in which the handle tube 14''' is free to index between the wide and narrow orientations. FIG. 29 shows the actuator sleeve 196 in a proximal or home position where the handle tube 14'' is in the narrow orientation.

Referring to FIGS. 25-29, to index the handle tube 14''', and therefore the base 16''', the sleeve 196 is moved to the retracted position. Specifically, the sleeve 196 is pushed distally, or away from the steam unit 12''', compressing the spring 194 and sliding the lugs 220 out of the end recesses 222 of the U-shaped tracks 218, as shown in FIG. 28. Next, the handle tube 14''' can be rotated 90 degrees by twisting the sleeve 196, which slides the lugs 220 to the opposite end of the circumferential track portion 224 of the U-shaped track 218. At 90 degrees rotation, the lugs 220 reach alignment with the other end recess 222, or return portion, of the U-shaped track 218 and slide upwardly to either proximal home position shown in FIG. 27 or 29 under the force of the compression spring 194, which urges the sleeve 196 proximally toward the steam unit 12'''. The reverse process is followed to index the handle tube 14''' and base 16''' back to the previous orientation. It is noted that the tabs 210 on the tube insert 190 remain engaged with the slots 212 in the sleeve 196 at all times during indexing, and thus, the handle tube 14''' and the sleeve 196 are interconnected as the sleeve 196 is rotated.

There are several advantages of the present disclosure arising from the various features of the apparatuses described herein. For example, the embodiments of the invention described above allow for quickly converting the steam mop 10 between different modes of operation.

Another advantage of the present disclosure is that embodiments of the base 16, 16', base 16'', base 16''' described above can quickly be indexed between different orientations, depending on the size of the area to be cleaned.

Another advantage of the present disclosure is that the interchangeable tools and tool caddy provide flexible application to different cleaning tasks in a user's home.

Yet another advantage of the present disclosure is that the steam unit 12 shown in the illustrated embodiment offers a more ergonomic and comfortable gripping position, with the pistol-style grip 20 positioned at the rear of the unit.

While various embodiments illustrated herein show a convertible steam mop, aspects of the invention may be used on other types of steam mops and steam cleaners, including non-convertible steam cleaners. Still further, aspects of the invention may also be used on surface cleaning apparatus other than steam cleaners, such as an apparatus configured to deliver liquid rather than steam.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A steam cleaning apparatus, comprising:

a steam unit comprising a steam unit housing, a steam generator provided in the steam unit housing, and a supply tank in fluid communication with the steam generator;

a handle tube, forming an elongated section, coupled with an outlet of the steam unit;

a base coupled with the handle tube and adapted to move over a surface to be cleaned in a direction of travel, the base comprising:

a base housing having a long edge and a short edge that is shorter than the long edge; and a steam distribution nozzle in fluid communication with the steam generator via the handle tube; and an indexing mechanism configured to move at least the base housing between a wide orientation where the long edge of the base housing is orthogonal to the direction of travel and a narrow orientation where the short edge of the base housing is orthogonal to the direction of travel.

2. The steam cleaning apparatus of claim 1, wherein the indexing mechanism is configured to move the base and the handle tube between the wide orientation and the narrow orientations.

3. The steam cleaning apparatus of claim 1, wherein the indexing mechanism comprises an actuator sleeve on an end of the handle tube coupled with the outlet of the steam unit.

4. The steam cleaning apparatus of claim 3, wherein the indexing mechanism further comprises a lug on the actuator sleeve and a track on the steam unit comprising at least a first end recess configured to receive the lug in the wide orientation and a second end recess configured to receive the lug in the narrow orientation.

5. The steam cleaning apparatus of claim 4, wherein the handle tube comprises an elongate tubular housing and a steam conduit extending through the elongate tubular housing, and the actuator sleeve is slidably and rotatably mounted on the elongate tubular housing.

6. The steam cleaning apparatus of claim 5, wherein the first end recess and the second end recess are circumferentially spaced about a longitudinal axis of the elongate tubular housing.

7. The steam cleaning apparatus of claim 5, wherein the indexing mechanism further comprises a spring biasing the actuator sleeve toward the steam unit.

8. The steam cleaning apparatus of claim 1, wherein the indexing mechanism comprises a keyed interface coupling between the handle tube and the steam unit that permits the handle tube to be mounted to the steam unit in at least a first position corresponding to the wide orientation and a second position corresponding to the narrow orientation.

9. The steam cleaning apparatus of claim 8, wherein the indexing mechanism further comprises a detent latch configured to lock the handle tube to the steam unit in one of the wide orientation or the narrow orientation.

10. The steam cleaning apparatus of claim 1, wherein the indexing mechanism further comprises a turret assembly about which the base housing is rotatable relative to the handle tube.

11. The steam cleaning apparatus of claim 10, wherein the steam distribution nozzle is provided on the turret assembly, and is positioned towards the long edge of the base housing in the wide orientation and the short edge of the base housing in the narrow orientation.

12. The steam cleaning apparatus of claim 11, wherein the base housing comprises an elongated steam outlet opening in a bottom thereof, and wherein the steam distribution nozzle is aligned with the elongated steam outlet opening in both the wide orientation and the narrow orientation.

13. The steam cleaning apparatus of claim 10, wherein the turret assembly comprises a swivel joint coupling the base to the handle tube for movement about at least a first axis of rotation and a second axis of rotation that is orthogonal to the first axis of rotation.

14. The steam cleaning apparatus of claim 10, wherein the indexing mechanism comprises a detent latch configured to lock the base housing to the turret assembly in one of the wide orientation or the narrow orientation and a foot pedal on the base operably coupled with the detent latch.

15. The steam cleaning apparatus of claim 1, wherein the base housing is generally rectangular, with the long edge and the short edge comprising generally straight sides of the base housing that meet at a common vertex.

16. The steam cleaning apparatus of claim 1, wherein the handle tube is detachable from the steam unit, and the steam cleaning apparatus is convertible to a handheld mode by detaching the handle tube from the steam unit.

17. The steam cleaning apparatus of claim 1, wherein the outlet of the steam unit comprises a steam unit distribution nozzle in fluid communication with the steam generator, and wherein the steam distribution nozzle is provided on a steam outlet conduit protruding from the steam unit housing.

18. The steam cleaning apparatus of claim 1, wherein the handle tube comprises:

an elongate tubular housing with a first end coupled with the steam unit and a second end coupled with the base;

a steam conduit within the elongate tubular housing; and a handle tube distribution nozzle provided at the second end in fluid communication with the steam conduit.

19. The steam cleaning apparatus of claim 1, and further comprising a cleaning pad mounted on the base housing.

20. The steam cleaning apparatus of claim 1, and further comprising an accessory tool caddy storing a plurality of accessory tools, wherein the accessory tool caddy is carried on the steam unit housing.

* * * * *